US008763506B2

(12) United States Patent
Ulrich et al.

(10) Patent No.: US 8,763,506 B2
(45) Date of Patent: Jul. 1, 2014

(54) ROLLER SYSTEM

(75) Inventors: Nathan Ulrich, Lee, NY (US); Joshua Koplin, Philadelphia, PA (US); Samuel Reeves, Philadelphia, PA (US); Stephen Ahnert, Philadelphia, PA (US); Erik De Brun, Philadelphia, PA (US)

(73) Assignee: Humanistic Robotics, Philadelphia, PA (US)

( * ) Notice: Subject to any disclaimer, the term of this patent is extended or adjusted under 35 U.S.C. 154(b) by 622 days.

(21) Appl. No.: 12/679,113

(22) PCT Filed: Sep. 19, 2008

(86) PCT No.: PCT/US2008/010890

§ 371 (c)(1),
(2), (4) Date: Nov. 22, 2010

(87) PCT Pub. No.: WO2009/038762

PCT Pub. Date: Mar. 26, 2009

(65) Prior Publication Data

US 2011/0048217 A1 Mar. 3, 2011

Related U.S. Application Data

(60) Provisional application No. 60/994,705, filed on Sep. 20, 2007.

(51) Int. Cl.
*F42B 23/00* (2006.01)

(52) U.S. Cl.
USPC ..... 89/1.13

(58) Field of Classification Search
USPC ..... 89/1.13; 102/402
See application file for complete search history.

(56) References Cited

U.S. PATENT DOCUMENTS

| | | | |
|---|---|---|---|
| 1,190,257 | A | 7/1916 | Henderson |
| 2,200,230 | A | 5/1940 | Hojnowski |
| 2,261,933 | A | 11/1941 | Flynn |
| 2,489,349 | A | 11/1949 | White |
| 2,745,330 | A | 5/1956 | Nelson |
| 2,919,754 | A | 1/1960 | Walberg |
| 3,199,608 | A | 8/1965 | Robbins |
| 3,716,005 | A | 2/1973 | Fennell |

(Continued)

FOREIGN PATENT DOCUMENTS

| | | |
|---|---|---|
| DE | 2048921 | 4/1972 |
| DE | 2622162 | 12/1977 |

(Continued)

OTHER PUBLICATIONS

Supplementary European Search Report for EP06824712 dated Feb. 9, 2011.

(Continued)

*Primary Examiner* — Daniel J Troy
(74) *Attorney, Agent, or Firm* — Michael W. Tieff

(57) ABSTRACT

A roller system including a frame, a plurality of arm assemblies configured to apply a force to a surface, each arm assembly including an arm pivotably connected to the frame and a roller assembly pivotably connected to the arm and having a plurality of rollers configured to engage with the surface, and a pressure distribution system configured to adjust the force applied to the surface by at least one of the plurality of arm assemblies.

38 Claims, 20 Drawing Sheets

(56) References Cited

U.S. PATENT DOCUMENTS

| | | | | |
|---|---|---|---|---|
| 3,771,413 | A * | 11/1973 | Sieg et al. | 89/1.13 |
| 4,065,094 | A | 12/1977 | Adams | |
| 4,593,766 | A | 6/1986 | Gossard | |
| 4,840,105 | A | 6/1989 | Ladan et al. | |
| 4,909,128 | A | 3/1990 | Grinwald | |
| 4,972,664 | A | 11/1990 | Frey | |
| 5,007,325 | A | 4/1991 | MacWatt | |
| 5,189,243 | A | 2/1993 | Hambric | |
| 5,313,868 | A | 5/1994 | Wolf | |
| 5,431,082 | A | 7/1995 | Zelverte et al. | |
| 5,706,899 | A | 1/1998 | Kiebanov et al. | |
| 5,786,542 | A | 7/1998 | Petrovich et al. | |
| 5,892,360 | A | 4/1999 | Willer et al. | |
| 5,936,185 | A | 8/1999 | Tokuni | |
| 5,979,289 | A | 11/1999 | French | |
| 5,979,290 | A | 11/1999 | Simeone | |
| 5,988,037 | A | 11/1999 | Haughom et al. | |
| 6,182,769 | B1 | 2/2001 | Karlen | |
| 6,371,001 | B1 | 4/2002 | Schmid | |
| 6,481,326 | B2 | 11/2002 | French | |
| 6,915,728 | B2 | 7/2005 | Renwick et al. | |
| 6,952,990 | B1 | 10/2005 | Clodfelter | |
| 7,013,982 | B2 | 3/2006 | Northcutt | |
| 7,100,489 | B1 | 9/2006 | Kendall | |
| 7,168,501 | B2 | 1/2007 | Willibald | |
| 7,198,112 | B2 | 4/2007 | Wanner | |
| 7,563,053 | B2 * | 7/2009 | Tyhy et al. | 404/126 |
| 2003/0196543 | A1 | 10/2003 | Moser et al. | |
| 2006/0266576 | A1 | 11/2006 | Eckhoff | |

FOREIGN PATENT DOCUMENTS

| | | |
|---|---|---|
| DE | 2632568 | 1/1978 |
| DE | 10259436 | 7/2004 |
| EP | 1004845 | 5/2000 |
| EP | 1371932 | 12/2003 |
| EP | 1882151 | 4/2006 |
| EP | 1688699 | 8/2006 |
| FR | 909874 | 5/1946 |
| FR | 917695 | 1/1947 |
| FR | 997365 | 1/1952 |
| FR | 1157301 | 5/1958 |
| FR | 1240528 | 9/1960 |
| FR | 2618540 | 1/1989 |
| GB | 1337183 | 11/1973 |
| GB | 2294910 | 5/1996 |
| JP | 11211397 | 8/1999 |
| JP | 11257894 | 9/1999 |
| JP | 2000046496 | 2/2000 |
| JP | 2000337796 | 12/2000 |
| JP | 2002090095 | 3/2002 |
| JP | 2003042698 | 2/2003 |
| JP | 2004177106 | 6/2004 |
| JP | 2004353945 | 12/2004 |
| JP | 2006064205 | 3/2006 |
| JP | 2006300397 | 11/2006 |
| WO | 9311402 | 6/1993 |
| WO | 9637752 | 11/1996 |
| WO | 9738281 | 10/1997 |
| WO | 9814748 | 4/1998 |
| WO | 9814749 | 4/1998 |
| WO | 0043725 | 7/2000 |
| WO | 0161270 | 8/2001 |
| WO | 03086842 | 10/2003 |
| WO | 2004072574 | 8/2004 |
| WO | 2004106839 | 12/2004 |
| WO | 2007/027217 | 3/2007 |

OTHER PUBLICATIONS

International Search Report for PCT/US2008/010890 completed on Nov. 18, 2008.

Habib, M.K. "Mechanization Technologies of Mine Clearing Operations . . . " Proceedings of the 11th World Congress in Mechanism and Machine Science, pp. 973-978, 2004.

Evans, W.J. et al. "Blast-Resistant Mine Clearing Wheels (Cast Steel)." Case Western Reserve University, Cleveland, OH, Jul. 9, 1974.

Edwards, D.C. "Expendable Mine-Clearing Roller (Ensure 202.1)." Army Mobility Equipment Research and Development Center, Fort Belvoir, VA, Jan. 1972.

Olofson, C.T. et al. "Feasibility of Forging Blast-Resistant Mine-Clearing Roller Wheels." Battelle Columbus Laboratories, Columbus, OH, Dec. 4, 1975.

International Search Report for PCT/US2006/015123, dated Feb. 15, 2007.

* cited by examiner

ROLLER SYSTEM

CROSS-REFERENCE TO RELATED APPLICATION

This application is a National Stage Patent Application of International Application No. PCT/US2008/010890, filed Sep. 19, 2008, which claims the benefit of U.S. Provisional Application No. 60/994,705, filed Sep. 20, 2007, which are both incorporated herein by reference in their entireties.

FIELD OF THE INVENTION

The present invention relates to a roller system, in particular a roller system operable to detonate land mines.

BACKGROUND OF THE INVENTION

At present, land mines are found in over sixty-five countries in a variety of environmental conditions. A number of different technologies have been employed in demining applications. These include, but are not limited to, rollers, flails, plows, and tillers. Each of these technologies has different performance characteristics, and in most demining applications, combinations of these technologies are used to ensure that the highest possible percentage of mines is detonated. In many situations, rollers are used as a first-pass treatment both to clear mines and also to prepare the soil for subsequent treatments. Compared to other systems, roller-type devices are mechanically simple, easy to maintain, and require less power to operate. Another major advantage is that rollers leave the host environment more intact in comparison to other systems that tend to remove or significantly disturb the soil. However, traditional roller-type devices face a number of drawbacks such as bridging, inconsistent ground pressure, and a lack of customizability.

Most existing roller assemblies make use of stacked or "free-floating" rollers. In this type of design, heavy annular rollers are placed side by side along a single shaft passing horizontally through the central opening of each roller, the diameter of the shaft being significantly smaller than the diameter of the central opening of each roller. This design allows each annular roller to move independently up, down, forward, and backward relative to the shaft to follow terrain variations. However, the maximum range of terrain variation that can be accommodated by such a design is dependent on the diameter of the central opening of the roller. If the variation in terrain along the width of the roller exceeds this dimension, some of the rollers may lift off of the ground, causing incomplete ground coverage and mine clearance ("bridging"). Bridging can also occur when the friction between adjacent rollers prevents a roller from fully contacting the ground. This often happens, for example, when a roller rolls over an obstruction that causes the roller to shift vertically relative to the shaft and adjacent rollers. As the roller comes back down, friction between it and the adjacent rollers prevents the roller from returning fully to the ground surface, leading to incomplete mine clearance. Friction between the rollers and friction between the rollers and the shaft also increases the amount of power that must be provided to operate the system. In addition to these issues, stacked roller-type devices also suffer from a lack of adjustability. Because the force exerted on the ground is dictated primarily by the weight of the rollers, it is virtually impossible to vary the amount of pressure exerted by the system without replacing the rollers. This is particularly disadvantageous since there are currently hundreds of land mine varieties, many of which require different amounts of force to detonate.

SUMMARY OF THE INVENTION

In one embodiment of the present invention there is disclosed a roller system having a frame, a plurality of arm assemblies configured to apply force to a surface, each arm assembly including an arm pivotably connected to the frame and a roller assembly pivotably connected to the arm and having a plurality of rollers configured to engage with the surface. In one embodiment, the roller system is configured to detonate a land mine positioned along or under the surface. In particular, in one embodiment, the rollers are configured to roll over the surface and detonate a land mine positioned along or under the surface.

In one embodiment, the rollers of a roller assembly are arranged in one or more rows. In one embodiment, the rollers are arranged in two or more rows, each row having one or more rollers. In one embodiment, the rows are substantially parallel. In one embodiment, at least two of the rows have different numbers of rollers. In one embodiment, at least two of the rows have the same number of rollers. In one embodiment, each sequential row has a greater number of rollers. In one embodiment, the rollers in a first row are staggered in relation to the rollers in a second row. In one embodiment, a distance between adjacent rollers in the first row is equal to or less than the width of a roller in the second row. In one embodiment, two or more rollers of a roller assembly have different axes of rotation. In one embodiment, the rollers of a roller assembly are arranged in a substantially triangular configuration. In one embodiment, each roller assembly includes three rollers.

In one embodiment, the roller assembly has at least one degree of freedom relative to the arm. In one embodiment, the roller assembly is configured to pivot relative to the arm in at least one vertical plane. In one embodiment, the roller assembly is configured to pivot forward and backward relative to the arm. In one embodiment, the roller assembly is configured to rotate about an axis of rotation that is substantially perpendicular to a longitudinal axis of the arm. In one embodiment, side-to-side motion of the roller assembly relative to the arm is limited.

In one embodiment, the arm is configured to pivot up and down relative to the frame. In one embodiment, the arm is configured to pivot relative to the frame towards the surface. In one embodiment, the arm assemblies are arranged substantially in a row along a portion of the frame. In one embodiment, the arm assemblies are arranged substantially parallel to each other.

In one embodiment, the roller system further includes a pressure distribution system configured to adjust the force applied to the surface by at least one of the plurality of arm assemblies. In one embodiment, the pressure distribution system is configured to equalize the force applied by each of the arm assemblies to the surface. In one embodiment, the pressure distribution system is configured to increase the force applied by at least one of the arm assemblies to the surface. In one embodiment, the pressure distribution system is configured to pivot at least one arm assembly towards the surface. In one embodiment, the pressure distribution system is configured to pivot at least one arm assembly downwards relative to the frame. In one embodiment, the pressure distribution system is configured to apply a force sequentially to each of the arm assemblies. In one embodiment, the pressure distribution system is configured to apply a downward force on at least one arm assembly. In one embodiment, the downward force pivots the at least one arm assembly towards the surface.

In one embodiment, the pressure distribution system includes a strut connected to at least one of the plurality of arm assemblies. In one embodiment, the strut is extendible. In one embodiment, the pressure distribution system includes a pressure source configured to pressurize the strut. In one embodiment, the pressure source comprises at least one of a compressor, pump, and gas cylinder. In one embodiment, the pressure distribution system further includes an accumulator in communication with the pressure source. In one embodiment, the pressure distribution system includes a plurality of struts, each of the plurality of struts connected to a different arm assembly. In one embodiment, at least two of the plurality of struts are in fluid communication with each other. In one embodiment, each of the plurality of struts is in fluid communication with each other. In one embodiment, the pressure distribution system includes a manifold and wherein at least two of the plurality of struts are connected to the manifold. In one embodiment, each of the plurality of struts has an equivalent steady-state pressure. In one embodiment, the strut comprises a piston. In one embodiment, the piston is a pneumatic or hydraulic piston. In one embodiment, the piston is a single-acting piston. In one embodiment, the piston is configured to pivot an arm assembly relative to the frame in response to a change in fluid pressure within the piston. In one embodiment, the pressure distribution system is a closed pneumatic system.

In one embodiment, the pressure distribution system includes a pressure source, a plurality of pneumatic circuits, each pneumatic circuit having a manifold and one or more pneumatic pistons connected to the manifold, and a switch having a plurality of positions for selectively connecting each pneumatic circuit with the pressure source. In one embodiment, each pneumatic piston of the pressure distribution system is connected to an arm assembly and configured to apply a force on the arm assembly when its respective pneumatic circuit is connected to the pressure source by the switch. In one embodiment, the switch includes a valve. In one embodiment, the switch is configured to connect each pneumatic circuit with the pressure source one at a time. In one embodiment, each switch position corresponds to a different pneumatic circuit, and wherein the switch is configured to cycle through each position.

In one embodiment, the frame is configured to be connected to a vehicle. In one embodiment, the frame is pivotably connected to the vehicle. In one embodiment, the frame is configured to pivot side-to-side relative to the vehicle. In one embodiment, the force applied to the surface by the arm assemblies is independent of the weight of the vehicle. In one embodiment, the frame is an expandable frame. In one embodiment, the frame includes a side member and a first transverse member removably connected to the side member, the first transverse member having a length and being positioned substantially perpendicular to the side member. In one embodiment, the frame is configured to permit substitution of the first transverse member with a second transverse member having a length different than the length of the first transverse member.

In one embodiment, the roller system is configured to allow the number of arms assemblies to be adjusted. In one embodiment, each arm assembly applies substantially the same amount of force on the surface. In one embodiment, at least two of the arm assemblies apply different amounts of force on the surface.

DETAILED DESCRIPTION

Figure 1A:
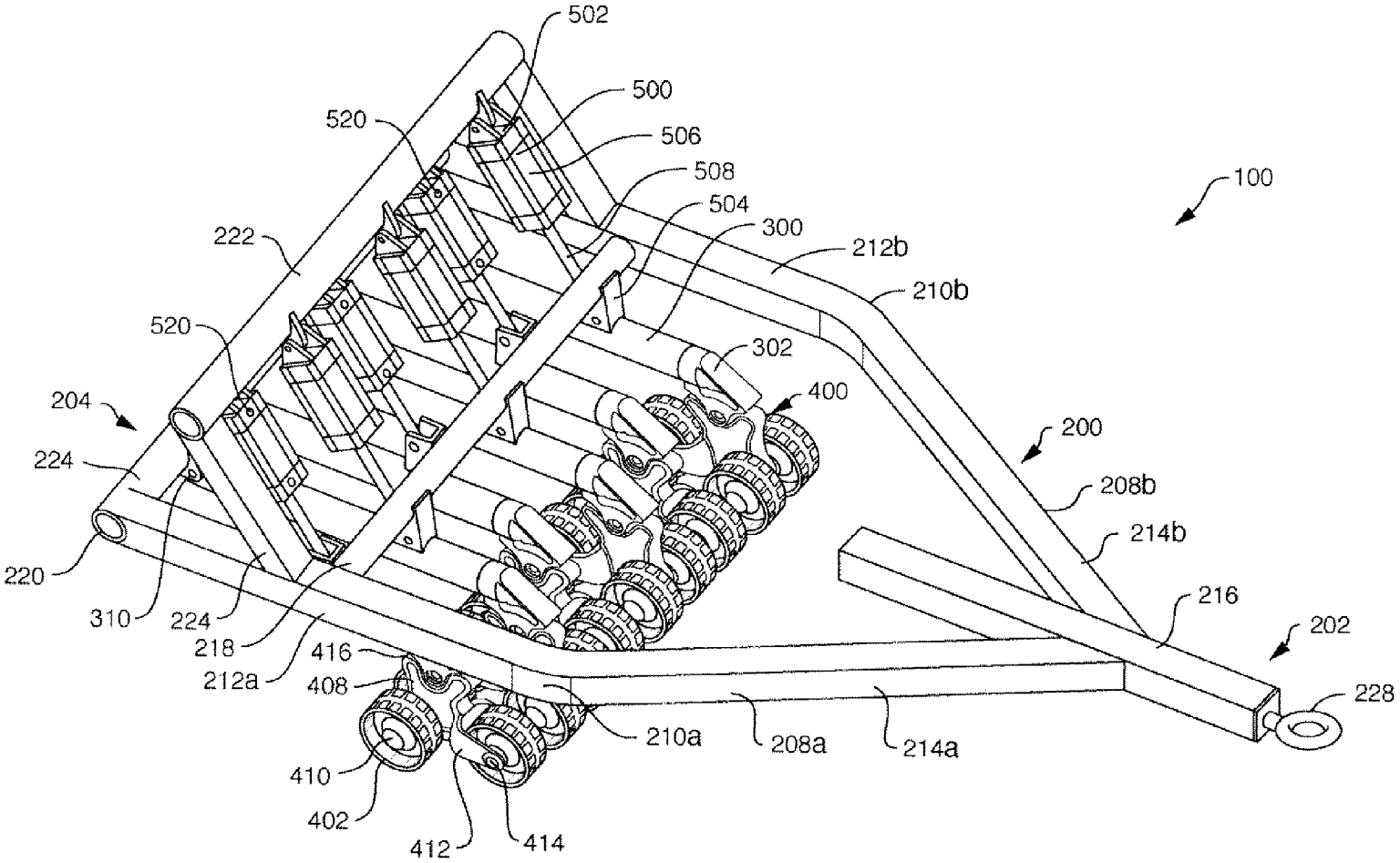
FIGS. 1A and 1B show a roller system in accordance with one embodiment of the present invention.

The present invention relates to a roller system, in one embodiment, a roller system operable to detonate land mines. A roller system 100 in accordance with one embodiment of the present invention is configured to traverse a surface (e.g., a ground surface) and detonate mines located on or under the surface. In some embodiments, a roller system 100 in accordance with the present invention includes one or more rollers 402 configured to roll upon the surface and apply a force sufficient to detonate mines on or below the surface. In some embodiments, rollers 402 are arranged in roller assembly 400 that is connected to a frame 200 by a pivoting arm 300. In some embodiments, frame 200 is configured to be secured to a host vehicle 600, which provides motive power for roller system 100 to traverse the surface. In some embodiments, roller system 100 includes a pressure distribution system configured to adjust the force applied to the surface.

Rollers:

Roller system 100, according to some embodiments of the invention, includes at least one roller 402. In some embodiments, roller system 100 includes a plurality of rollers 402. In one embodiment, roller system 100 includes any suitable number of rollers 402. In one embodiment, the number of rollers 402 in roller system 100 is adjustable. In one embodiment, roller system 100 includes an odd number of rollers 402. In one embodiment, roller system 100 includes an even number of rollers 402. In one embodiment, the number of rollers 402 in roller system 100 is a multiple of three. In one embodiment, the number of rollers 402 in roller system 100 is a multiple of four. In one embodiment, the number of rollers 402 in roller system 100 is a multiple of five. In one embodiment, the number of rollers 402 in roller system 100 is a multiple of six. In one embodiment, the number of rollers 402 in roller system 100 is a multiple of seven. In one embodiment, the number of rollers 402 in roller system 100 is a multiple of eight. In one embodiment, roller system 100 includes one to eighty rollers 402. In one embodiment, roller system 100 includes one to seventy rollers 402. In one embodiment, roller system 100 includes one to sixty rollers 402. In one embodiment, roller system includes one to fifty rollers 402. In one embodiment, roller system 100 includes one to forty rollers 402. In one embodiment, roller system includes one to thirty rollers 402. In one embodiment roller system 100 includes one to twenty rollers 402. In one embodiment, roller system 100 includes one to ten rollers 402. In one embodiment, roller system 100 includes more than eighty rollers 402.

Figure 1B:
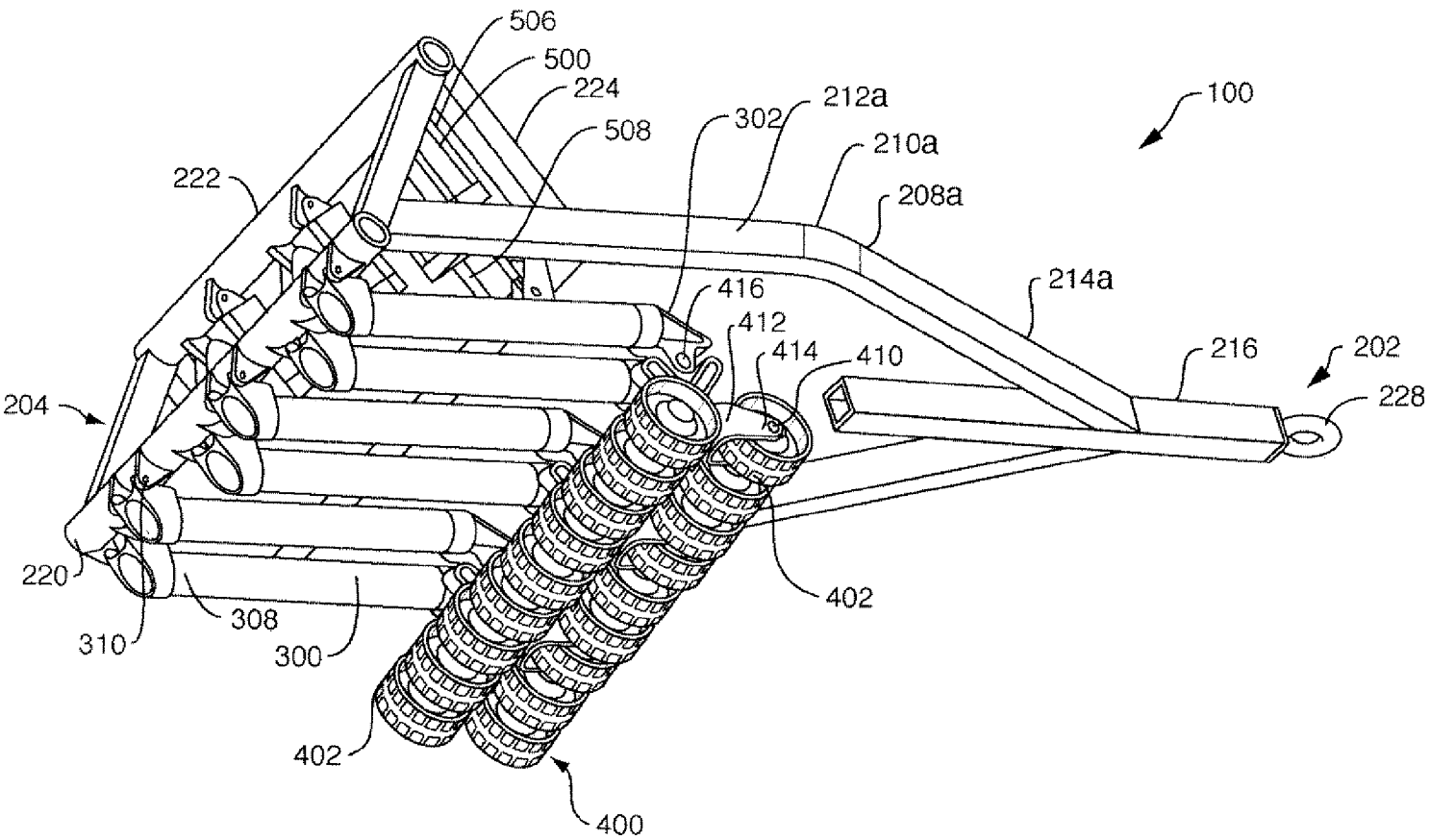

In the particular embodiment shown in FIGS. 1A and 1B, roller system 100 includes eighteen rollers 402. In one embodiment, roller system 100 includes three rollers 402. In one embodiment, roller system 100 includes six rollers 402. In one embodiment, roller system 100 includes nine rollers 402. In one embodiment, roller system 100 includes twelve rollers 402. In one embodiment, roller system 100 includes fifteen rollers 402. In one embodiment, roller system 100 includes twenty-one rollers 402. In one embodiment, roller system 100 includes twenty-four rollers 402. In one embodiment, roller system 100 includes twenty-seven rollers 402. In one embodiment, roller system 100 includes thirty rollers 402. In one embodiment, roller system 100 includes thirty-three rollers 402. In one embodiment, roller system 100 includes thirty-six rollers 402. In one embodiment, roller system 100 includes thirty-nine rollers 402. In one embodiment, roller system 100 includes forty-two rollers 402. In one embodiment, roller system 100 includes forty-five rollers 402. In one embodiment, roller system 100 includes forty-eight rollers 402. In one embodiment, roller system 100 includes fifty-one rollers 402. In one embodiment, roller system 100 includes fifty-four rollers 402. In one embodiment, roller system 100 includes fifty-seven rollers 402. In one embodiment, roller system 100 includes sixty rollers. In one embodiment, roller system 100 includes more than sixty rollers 402.

In some embodiments, each roller 402 is configured to engage with a surface. In some embodiments, each roller 402 is configured to engage with a ground surface. In some embodiments, roller 402 has an axis of rotation. In some embodiments, roller 402 is configured to roll over a surface. In some embodiments, roller 402 is configured to apply a force upon a surface. In some preferred embodiments, roller 402 is configured to detonate land mines situated on or under a ground surface. In one embodiment, roller 402 is a disc. In one embodiment, roller 402 is a cylinder. In one embodiment, roller 402 is a wheel. In one embodiment, roller 402 has an even circumferential surface. In one embodiment, roller 402 has a textured circumferential surface. In one embodiment roller 402 has a grooved circumferential surface. In one embodiment, roller 402 is provided with treads. Rollers 402 may be constructed of any suitable material known in the art. For example, rollers 402 may be constructed from metal (e.g., steel, titanium, aluminum, alloys), carbon fiber, fiber glass, rigid plastics, composites, etc. In some embodiments, rollers 402 are solid. In some embodiments, rollers 402 are hollow. In some embodiments, rollers 402 may be filled with additional material to increase the weight of the rollers 402. For example, rollers 402 may include a closeable inlet to allow rollers 402 to be filled with water, sand, pebbles, metal balls or pellets. In one embodiment, roller 402 is configured substantially similar to the rollers and wheels described in U.S. Pat. No. 3,771,413, U.S. Pat. No. 5,786,542, U.S. Pat. No. 6,915,728, U.S. Pat. No. 7,100,489, and U.S. Patent Application Publication No. 2006/0266576, all of which are incorporated herein by reference in their entireties.

Each roller 402 may have any suitable width. In some embodiments, each roller 402 in roller system 100 has substantially the same width. In some embodiments, roller system 100 includes rollers 402 having different widths. In one embodiment, the width of roller 402 determines the width of surface that is covered by the roller 402. In some embodiments, roller 402 has a width of about one inch to about twelve inches. In some embodiments, roller 402 has a width of about one inch to about eleven inches. In some embodiments, roller 402 has a width of about one inch to about ten inches. In some embodiments, roller 402 has a width of about one inch to about nine inches. In some embodiments, roller 402 has a width of about one inch to about eight inches. In some embodiments, roller 402 has a width of about one inch to about seven inches. In some embodiments, roller 402 has a width of about one inch to about six inches. In some embodiments, roller 402 has a width of about one inch to about five. In some embodiments, roller 402 has a width of about one inch to about four inches. In some embodiments, roller 402 has a width of about one inch to about three inches. In some embodiments, roller 402 has a width of about one inch to about two inches. In some embodiments, roller 402 has a width of about two inches to about five inches. In some embodiments, roller 402 has a width of about two inches to about four inches. In a preferred embodiment, roller 402 has a width of about three inches. In some embodiments, roller 402 has a width greater than about twelve inches.

Each roller 402 may have any suitable diameter. In some embodiments, roller 402 has a diameter of about two inches to about twenty-four inches. In some embodiments, roller 402 has a diameter of about four inches to about twenty-two inches. In some embodiments, roller 402 has a diameter of about six inches to about twenty inches. In some embodiments, roller 402 has a diameter of about eight inches to about eighteen inches. In some embodiments, roller 402 has a diameter of about ten inches to about sixteen inches. In some embodiments, roller 402 has a diameter of about twelve inches. In some embodiments, roller 402 has a diameter greater than about twenty-four inches.

Each roller 402 may have any weight suitable for clearing land mines. In some embodiments, each roller 402 in roller system 100 has substantially the same weight. In some embodiments, roller system 100 includes rollers 402 having different weights. In some embodiments, roller 402 weighs from about ten pounds to about fifty pounds. In some embodiments, roller 402 weighs from about fifteen pounds to about forty-five pounds. In some embodiments, roller 402 weighs from about twenty pounds to about forty pounds. In some embodiments, roller 402 weighs from about twenty-five pounds to about thirty-five pounds. In some embodiments, roller 402 weighs about thirty pounds. In a preferred embodiment, roller 402 weighs less than about thirty pounds. In one embodiment, roller 402 weighs less than twenty-five pounds. In one embodiment, roller 402 weighs about twenty-four pounds. In some embodiments, roller 402 weighs more than fifty pounds.

Roller Assembly:

In some embodiments, one or more rollers 402 are arranged in a roller assembly 400. In some embodiments, each roller assembly 400 includes at least one roller 402. In some embodiments, roller assembly 400 includes a plurality of rollers 402. In some embodiments, any suitable number of rollers 402 may be included in roller assembly 400. In some embodiments, roller assembly 400 includes an odd number of rollers 402. In some embodiments, roller assembly 400 includes an even number of rollers 402. In one embodiment, roller assembly 400 includes one roller 402. In one embodiment, roller assembly 400 includes two rollers 402. In one embodiment, roller assembly 400 includes three rollers 402. In one embodiment, roller assembly includes four rollers 402. In one embodiment, roller assembly 400 includes five rollers 402. In one embodiment, roller assembly 400 includes six rollers 402. In one embodiment, roller assembly 400 includes seven rollers 402. In one embodiment, roller assembly 400 includes eight rollers 402. In one embodiment, roller assembly 400 includes nine rollers 402. In one embodiment, roller assembly 400 includes ten rollers 402. In one embodiment, roller assembly 400 includes more than ten rollers 402.

Rollers 402 may be arranged in any suitable configuration in roller assembly 400. In one embodiment, rollers 402 in roller assembly 400 are arranged to have a common tangent plane. In one embodiment, rollers 402 in roller assembly 400 are arranged such that two or more rollers 402 have a common axis of rotation. In one embodiment, rollers 402 in roller assembly 400 are arranged such that two or more rollers 402 have different axes of rotation. In one embodiment, the different axes of rotation are substantially parallel. In one embodiment, the different axes of rotation are not substantially parallel. In one embodiment, the different axes of rotation lie in a common plane. In one embodiment, the different axes of rotation do not lie in a common plane. In one embodiment, rollers 402 in roller assembly 400 are arranged in a single row. In one embodiment, rollers 402 in roller assembly 400 are arranged in two or more rows, each row having one or more rollers 402. In one embodiment, the two or more rows are substantially parallel. In one embodiment, rollers 402 in roller assembly 400 are arranged in two or more rows, such that rollers 402 in one row are staggered in relation to the rollers 402 in different row. In one embodiment, staggering the rollers 402 in different rows permits the rollers 402 in one row to cover ground surface not covered by a second row (e.g., the ground surface missed by the gaps between adjacent rollers 402 in the second row). In one embodiment, rollers 402 in roller assembly 400 are arranged in two or more rows, each row having the same number of rollers 402. In one embodiment, rollers 402 in roller assembly 400 are arranged in two or more rows, each row having a different number of rollers 402. In one embodiment, rollers 402 in roller assembly 400 are arranged in two or more rows, each sequential row having a greater number of rollers 402 relative to the previous row. In preferred embodiments, when rollers 402 are arranged in one or more rows, the distance between each pair of adjacent rollers 402 in the same row is equal to or less than the width of a single roller 402. In one embodiment, rollers 402 are arranged in two or more rows such that the distance between adjacent rollers 402 in one row is equal to or less than the width of a roller 402 in a different row. In one embodiment, rollers 402 in roller assembly 400 are arranged in a substantially triangular configuration. In one embodiment, roller assembly 400 is configured to be a tricycle-style assembly.

In some embodiments, roller assembly 400 includes a roller mount 408 having one or more axles 410 to which rollers 402 are mounted. Roller mount 408 may have any configuration necessary to arrange rollers 402 in roller assembly 400 as described above. In some embodiments, roller mount 408 is configured to maintain each roller 402 in roller assembly 400 in fixed positional relation to each other. In some embodiments, roller mount 408 is configured to maintain a distance D between adjacent rollers 402 in roller assembly 400. In preferred embodiments, distance D is equal to or less than the width of a roller 402. In some embodiments, roller mount 408 includes a number of axles 410 at least equal to the number of rollers 402 in roller assembly 400. In some embodiments, each roller 402 in roller assembly 400 is mounted to a different axle. In some embodiments, roller mount 408 includes a number of axles at least equal to the number of different axes of rotation of rollers 402 in roller assembly 400. In some embodiments, two or more rollers 402 having a common axis of rotation may be mounted on a single axle 410. In some embodiments, roller mount 408 may include a bifurcated or U-shaped bracket 412 having side pieces 414 between which one or more rollers 402 may be mounted.

Figure 4:
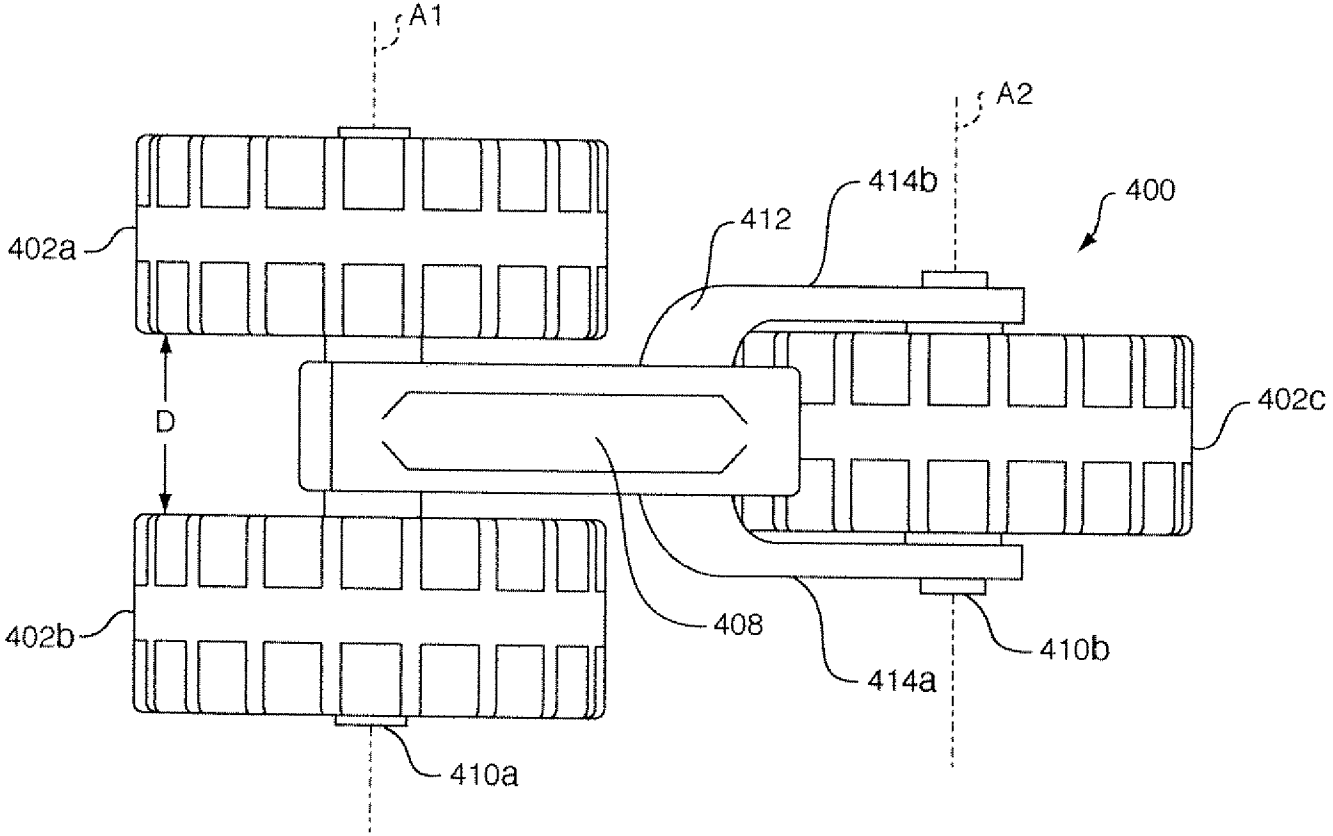
FIG. 4 shows a roller assembly in accordance with one embodiment of the present invention.

FIG. 4 shows one example of a roller assembly 400 in accordance with the present invention. In this particular embodiment, roller assembly 400 includes three rollers 402*a*, 402*b*, and 402*c* mounted on a roller mount 408. Rollers 402*a* and 402*b* have a common axis of rotation A1 and are arranged in a first row along a first axle 410*a*. The roller 402*c* has an axis of rotation A2 substantially parallel to axis of rotation A1 and is positioned between side pieces 414*a* and 414*b* of bracket 412 in a second row along a second axle 410*b*. As shown in FIG. 4, rollers 402*a*, 402*b*, and 402*c* are arranged in a substantially triangular arrangement with roller 402*c* being staggered relative to rollers 402*a* and 402*b*. In this embodiment, rollers 402*a* and 402*b* are separated by a distance D that is equal to or preferably less than the width of roller 402*c*.

Roller system 100 may include any suitable number of roller assemblies 400. In some embodiments, roller system 100 includes at least one roller assembly 400. In some embodiments, roller system 100 includes a plurality of roller assemblies 400. In some embodiments, roller system 100 includes one to ten roller assemblies 400. In some embodiments, roller system 100 includes two to nine roller assemblies 400. In some embodiments, roller system 100 includes three to eight roller assemblies 400. In some embodiments, roller system 100 includes four to seven roller assemblies 400. In some embodiments, roller system 100 includes five or six roller assemblies 400. In some embodiments, roller system 100 includes more than ten roller assemblies 400.

In some embodiments, roller system 100 includes roller assemblies 400 having the same number of rollers 402. In some embodiments, roller system 100 includes roller assemblies 400 having different numbers of rollers 402. In some embodiments, roller system 100 includes roller assemblies 400 having the same arrangement of rollers 402. In some embodiments, roller system 100 includes roller assemblies 400 having different arrangements of rollers 402. In the embodiment shown in FIGS. 1A and 1B, roller system 100 includes a plurality of assemblies 400 wherein adjacent roller assemblies 400 have alternately arranged rollers 402. In this particular embodiment, for example, one roller assembly 400 includes one front roller 402 and two rear rollers 402 whereas an adjacent roller assembly 400 includes two front rollers 402 and one rear roller 402. In this embodiment, roller assemblies 400 is preferably spaced such that the track width of one roller assembly 400 will partially overlap the track width of an adjacent roller assembly 400, thus providing for a more complete coverage of the ground surface.

Arms:

In some embodiments of the invention, one or more roller assemblies 400 are connected to an arm 300 having a proximal end 304 and a distal end 306. In one embodiment, each roller assembly 400 is connected to an arm 300. In one embodiment, each roller assembly 400 is connected to a different arm 300. In one embodiment, roller assembly 400 is connected to the proximal end 304 of arm 300. In one embodiment, roller mount 408 of roller assembly 400 is connected to the proximal end 304 of arm 300. In some embodiments, roller assembly 400 is configured to move (e.g., pivot, swivel, slide) relative to arm 300. In some embodiments, by permitting roller assembly 400 to move relative to arm 300, rollers 402 in roller assembly 400 can better track the terrain of a surface (e.g., a ground surface) by adjusting to local variations on the surface. In some embodiments, roller assembly 400 is configured to pivotably engage with arm 300. In some embodiments, roller assembly 400 is configured to slidably engage with arm 300. In one embodiment, roller assembly 400 is mounted to arm 300 by a joint 416. In one embodiment, joint 416 may be any type of joint that permits roller assembly 400 to articulate relative to arm 300. In one embodiment, joint 416 provides roller assembly with at least one degree of freedom. In one embodiment, joint 416 provides roller assembly with at least two degrees of freedom relative. In one embodiment, joint 416 provides roller assembly with at least three degrees of freedom. In one embodiment, joint 416 provides roller assembly with at least four degrees of freedom. In one embodiment, joint 416 provides roller assembly with at least five degrees of freedom. In one embodiment, joint 416 provides roller assembly with at least six degrees of freedom. In one embodiment, joint 416 is configured to permit roller assembly 400 to perform at least one of the following: move forward and backward relative to arm 300, move side-to-side relative to arm 300, and swivel relative to arm 300. In one embodiment, roller assembly 400 is configured to move (e.g., pivot) relative to arm 300 in at least one vertical plane. In one embodiment, roller assembly 400 is configured to rotate about an axis of rotation that is substantially perpendicular to a longitudinal axis of arm 300 (e.g., the longitudinal axis extending between proximal end 304 and distal end 306 of arm 300). In one embodiment, joint 416 limits or inhibits side-to-side motion of roller assembly 400 relative to arm 300. In one embodiment, joint limits or inhibits swiveling of roller assembly 400 relative to arm 300.

In one embodiment, joint 416 includes a spherical bearing. In one embodiment, joint 416 includes a ball and socket joint. In one embodiment, joint 416 includes an ellipsoidal joint. In one embodiment, joint 416 is a universal joint. In one embodiment, joint 416 includes a hinge, pin, or axle that permits roller assembly 400 to pivot forward and backward relative to arm 300.

Figure 2A:
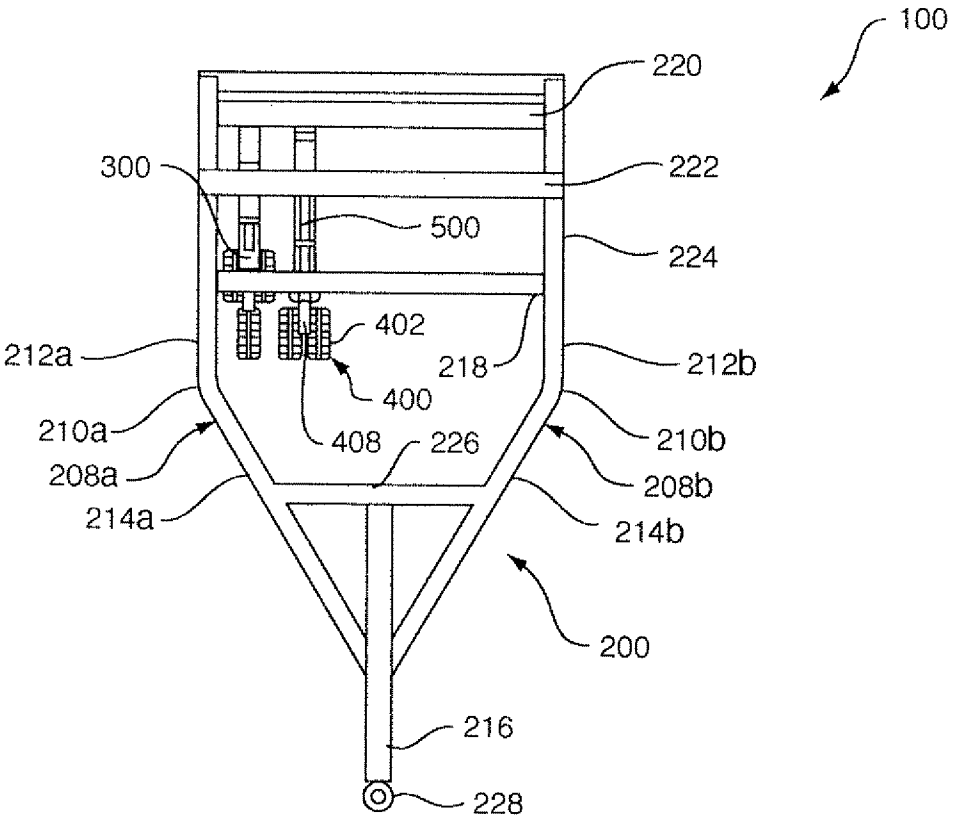
FIGS. 2A-2C show a roller system in accordance with one embodiment of the present invention.
Figure 2B:
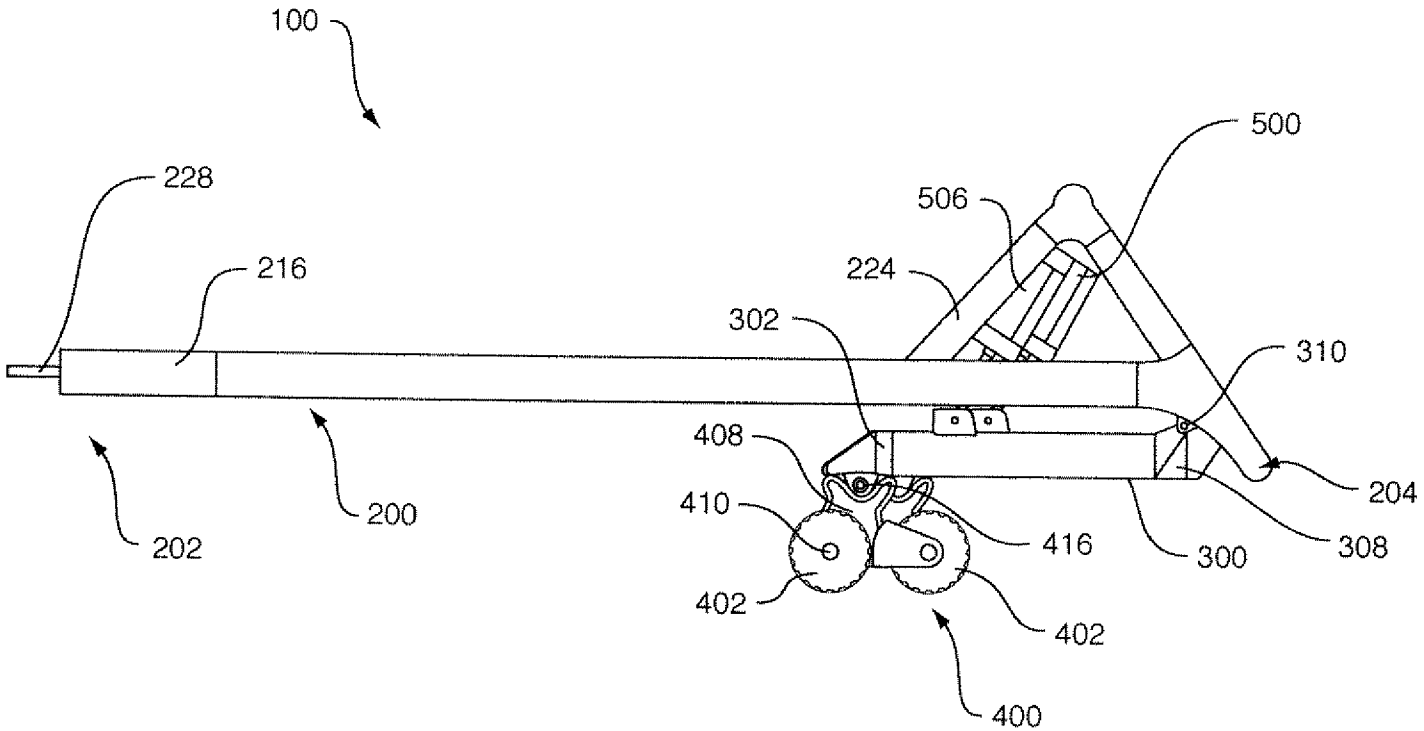
Figure 2C:
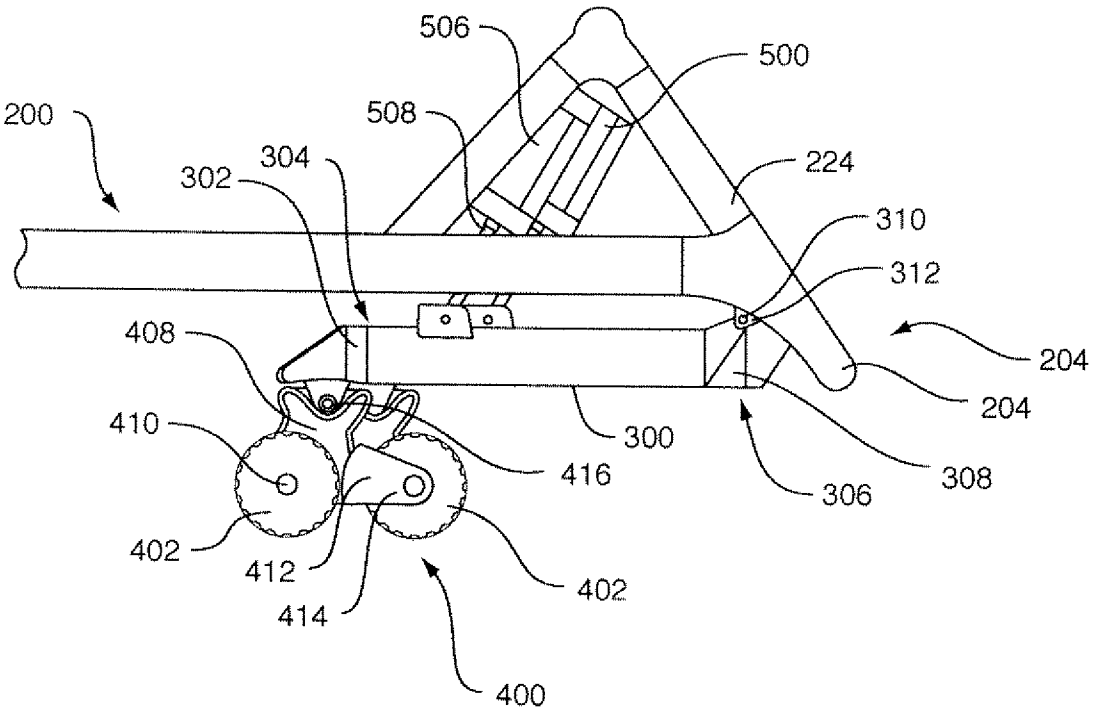
Figure 3A:
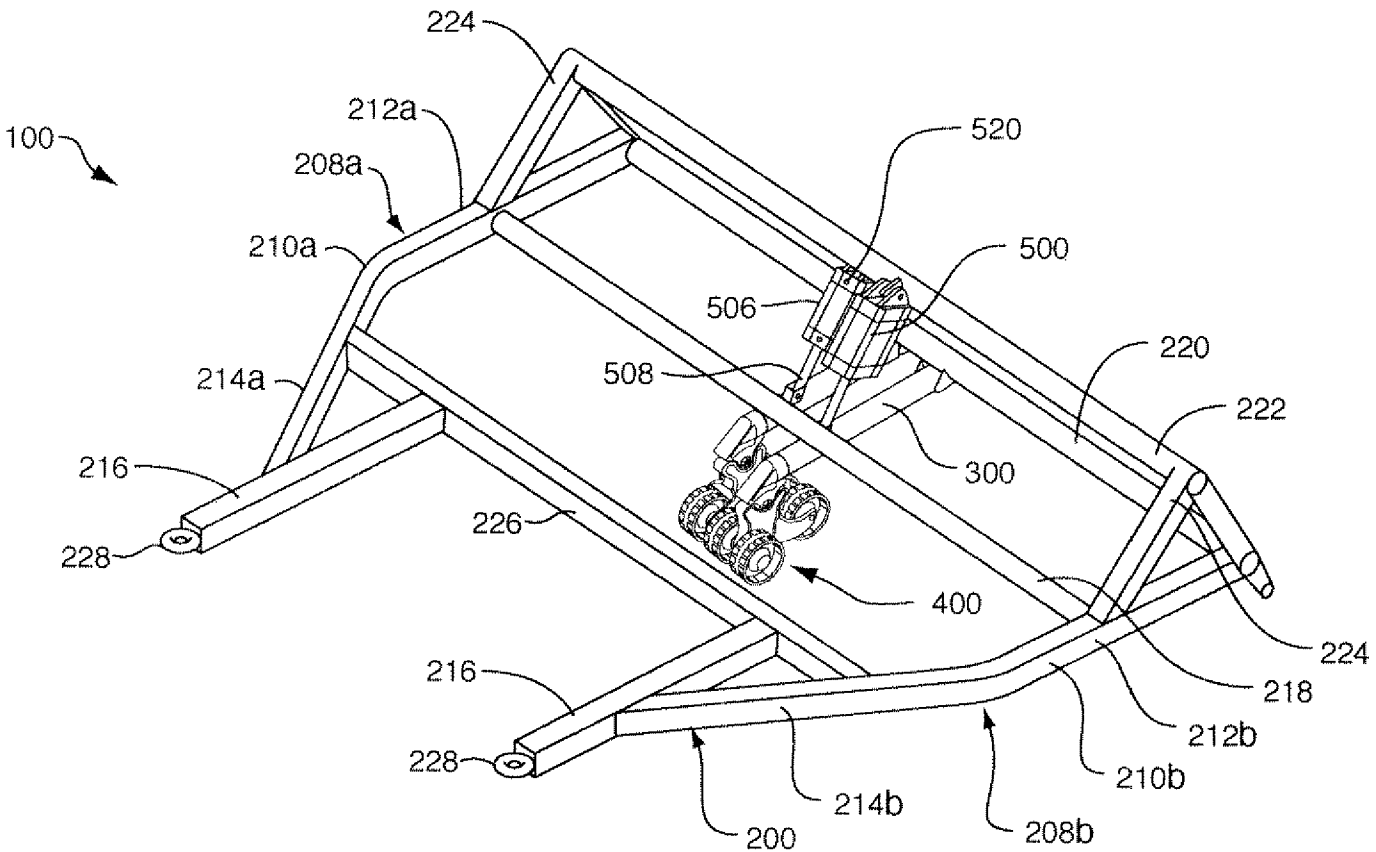
FIGS. 3A-3C show a roller system in accordance with one embodiment of the present invention.
Figure 3B:
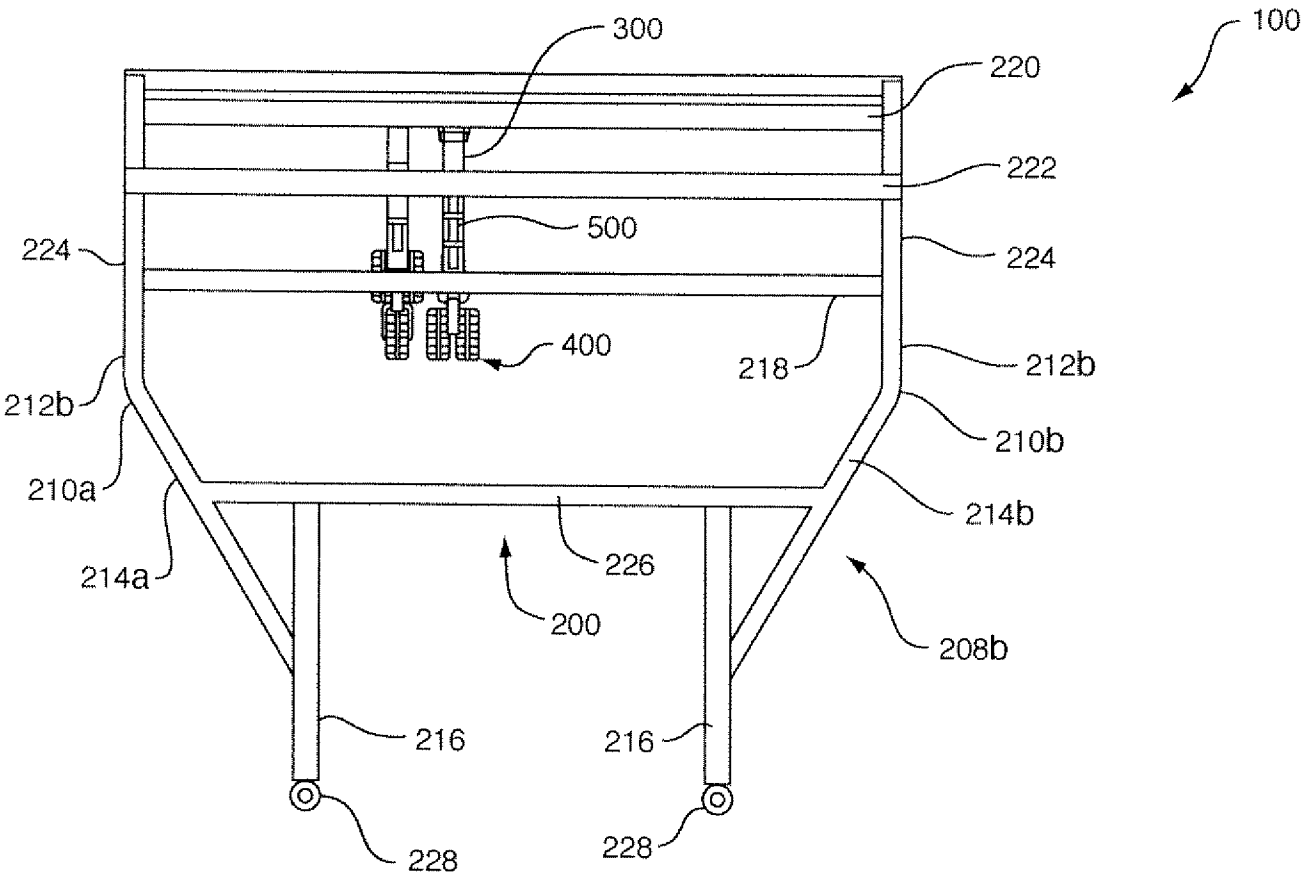
Figure 3C:
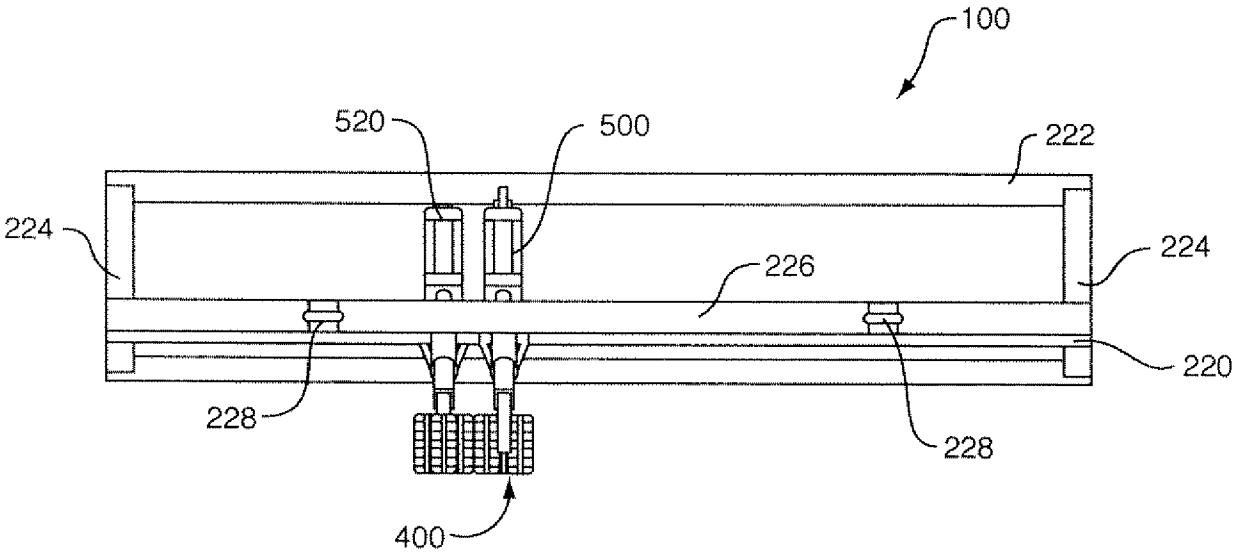

In one embodiment arm 300 is connected to frame 200 at distal end 306 of arm 300, for example, as shown in FIG. 2C. In some embodiments, arm 300 is configured to move relative to frame 200. In some embodiments, arm 300 is pivotably connected to frame 200. In one embodiment, permitting arm 300 to move relative to frame 200 allows rollers 402 to track large terrain variations in the ground surface. In one embodiment, arm 300 is connected to frame 200 such that arm 300 has at least one degree of freedom with respect to frame 200. In one embodiment, arm 300 is connected to frame 200 such that arm 300 has at least two degrees of freedom with respect to frame 200. In one embodiment, arm 300 is connected to frame 200 such that arm 300 has at least three degrees of freedom with respect to frame 200. In one embodiment, arm 300 is configured to move (e.g., pivot) relative to frame 200 in at least one plane. In one embodiment, arm 300 is configured to move (e.g., pivot) relative to frame 200 in at least one vertical plane. In one embodiment, arm 300 is configured to move (e.g., pivot) up and down relative to frame 200. In one embodiment, arm 300 is configured to move (e.g., pivot) forward and backward relative to frame 200. In one embodiment, arm 300 is configured to move (e.g., pivot) side-to-side relative to frame 200. In one embodiment, arm 300 is connected to frame 200 by an arm pivot 308 positioned at distal end 306 of arm 300 and configured to rotate about an axle, pin, or hinge 310 connected to a bracket 312 mounted onto frame 200.

Arm 300 may be mounted to frame 200 in any manner known in the art. In some embodiments, the attachment point of arm 300 to frame 200 is fixed. For example, arm 300 may be pivotably connected to a bracket 312 that is welded, brazed, soldered, adhered, fused, glued, or integral to frame 200. In other embodiments, for example, arm 300 may be pivotably connected to bracket 312 that is mechanically attached (e.g., fastened, clamped, bolted, screwed, or nailed) to frame 200. In some embodiments, arm 300 is adjustably mounted onto frame 200 such that the specific position along frame 200 at which arm 300 is mounted may be adjusted. In some embodiments, arm 300 is preferably mounted onto frame 200 such that arm 300 may be easily removed from or added to frame 200. This configuration is particularly advantageous, for example, when arm 300 is damaged and needs to be replaced or when frame 200 is an adjustable frame as will be described in further detail. In one embodiment, arm 300 is mounted to frame 200 using a clamp that may be loosened or detached from frame 200. In one embodiment, arm 300 is mounted on to frame 200 using collar clamps that allow arm 300 to be detached from frame 200.

In the embodiments shown in FIGS. 1A-1B, 2A-2C, and 3A-3C, roller system 100 may include a plurality of arms 300 mounted onto frame 200. In some embodiments, roller system 100 has a modular configuration such that the number of arms 300 may be adjusted by removing or adding arms 300 as needed. In preferred embodiments, each arm 300 pivots independently with respect to frame 200. In some embodiments, roller system 100 may include a number of arms 300 less than the number of roller assemblies 400. For example, in one configuration a plurality of roller assemblies 400 may be connected to a single arm 300. In other embodiments, roller system 100 may include a number of arms 300 greater than the number of roller assemblies 400. For example, in one configuration one or more arms 300 may be connected to a single roller assembly 400. In preferred embodiments, roller system 100 includes a number of arms 300 equal to the number of roller assemblies 400. In these embodiments, each roller assembly 400 may be connected to a different arm 300, as shown in FIGS. 1A-1B, 2A-2C, and 3A-3C.

Arm 300 may be constructed from any suitable material. For example, arm 300 may be constructed from metal (e.g., steel, titanium, aluminum, alloys), carbon fiber, fiber glass, rigid plastics, composites, etc. In some embodiments, arm 300 is solid. In some embodiments, arm 300 is hollow. Arm 300 may also have any suitable length. In some embodiments, arm 300 is about one foot to about ten feet in length. In some embodiments, arm 300 is about one foot to about eight feet in length. In some embodiments, arm 300 is about one foot to about seven feet in length. In some embodiments, arm 300 is about one foot to about six feet in length. In some embodiments, arm 300 is about one foot to about five feet in length. In some embodiments, arm 300 is about one foot to about four feet in length. In some embodiments, arm 300 is about one foot to about three feet in length. In some embodiments, arm 300 is about one foot to two feet in length. In some embodiments, arm 300 is more than ten feet in length. In some embodiments, arm 300 is about twelve inches to about forty-eight inches in length. In some embodiments, arm 300 is about eighteen inches to about forty-two inches in length. In some embodiments, arm 300 is about twenty-four inches to about thirty-six inches in length. In preferred embodiments, arm 300 is about thirty inches in length. In some embodiments, the length of arm 300 may be extendible or shortened. For example, in one embodiment, arm 300 may have a telescoping configuration.

Figure 5A:
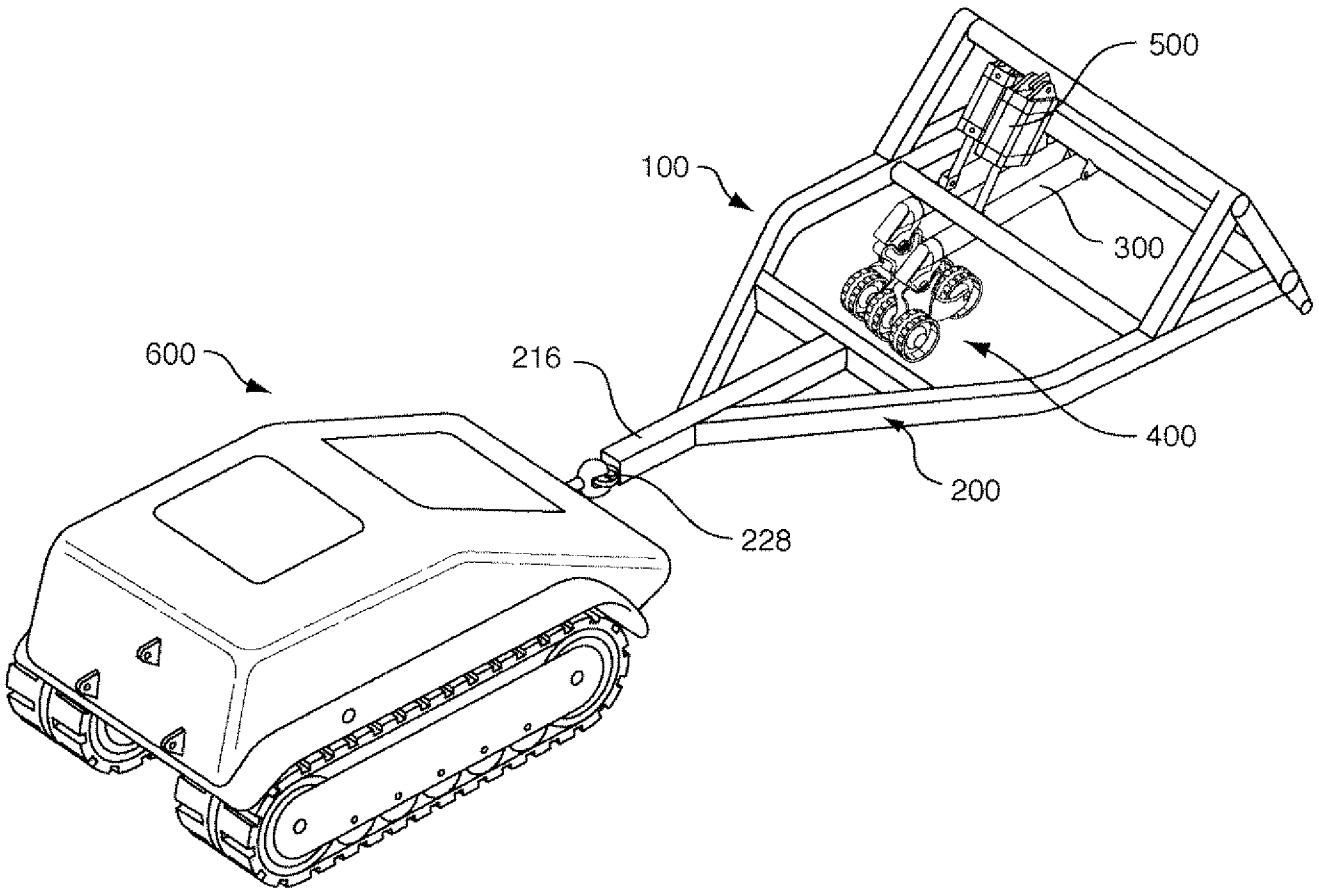
FIGS. 5A-5C show the roller system of FIGS. 2A-2C attached to a host vehicle in accordance with one embodiment of the present invention.
Figure 5B:
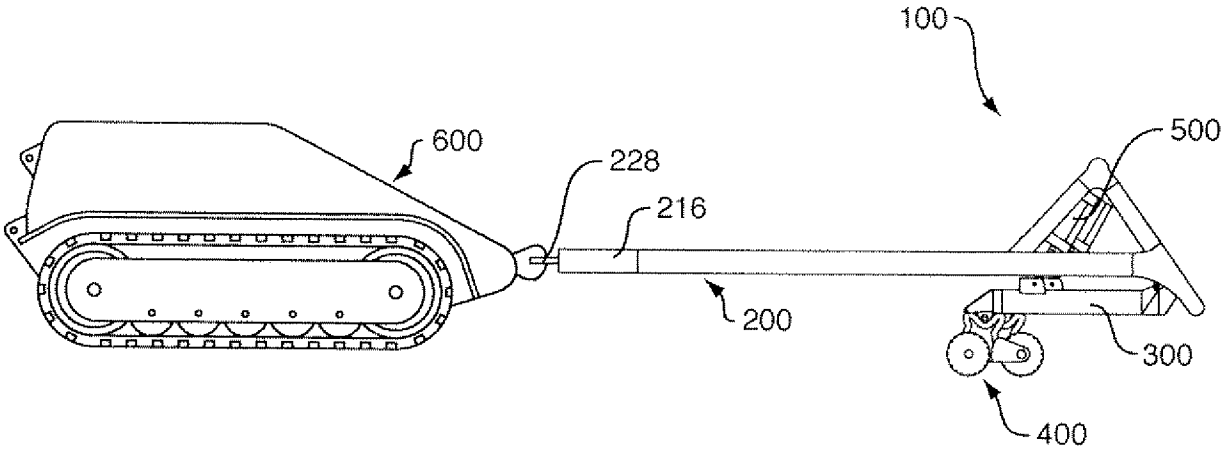
Figure 5C:
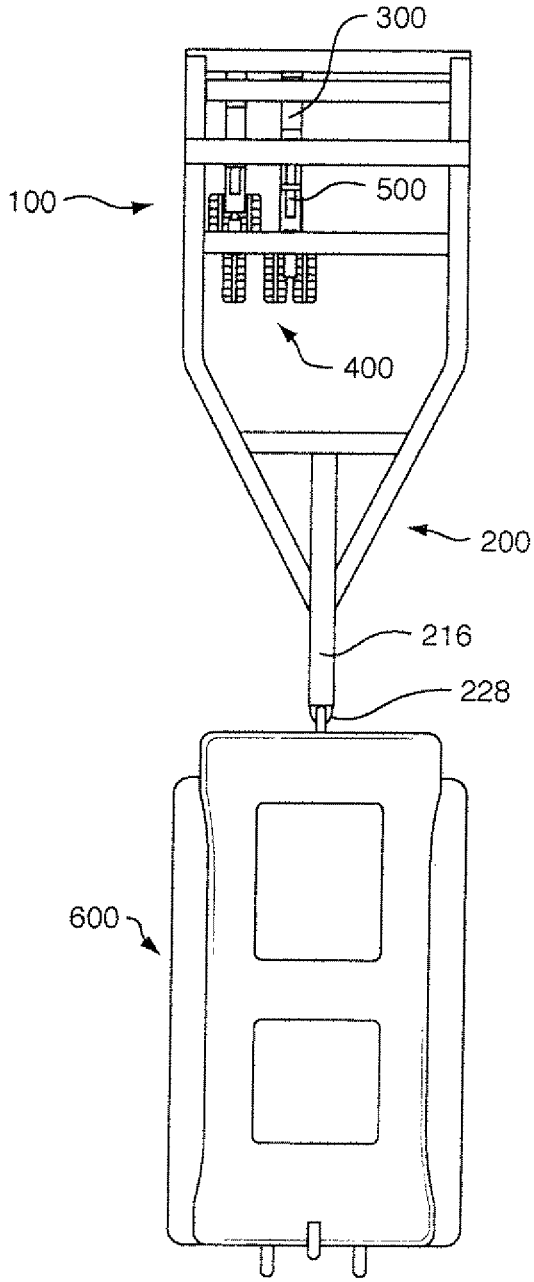
Figure 6:
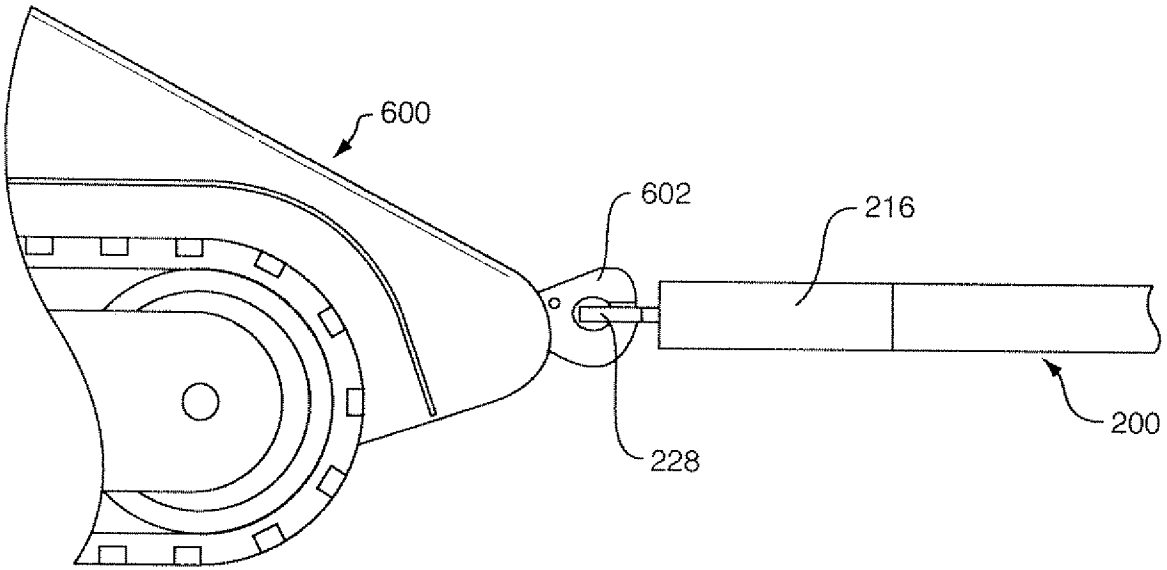
FIG. 6 shows a vehicle mounting arrangement in accordance with one embodiment of the present invention.

Frame:

Frame 200 may have any suitable configuration. In some embodiments, frame 200 is configured to be secured to a host vehicle 600, which may be any suitable vehicle known in the art (e.g., tank, personnel carrier, unmanned vehicle, etc.). FIGS. 5A-5C show an example of a roller system 100 connected to a host vehicle 600. In some embodiments, frame 200 is configured to be removably attached to host vehicle 600. In some embodiments, frame 200 is configured to be integral with host vehicle 600. Preferably the force applied by roller system 100 to a surface is independent of the weight of the host vehicle. In some embodiments, frame 200 is rigidly connected to the host vehicle 600. In some embodiments, frame 200 is configured to move (e.g., pivot) relative to the host vehicle. In some embodiments, frame 200 is semi-rigidly connected to the host vehicle 600. For example, frame 200 is connected to host vehicle 600 using a hinge, ball-joint, or pintle ring that permits articulation between frame 200 and host vehicle 600. As shown in FIG. 6, in one embodiment frame 200 includes a pintle ring 228 that connects with vehicle mount 602 positioned on host vehicle 600. In some embodiments, frame 200 is configured to rotate about a vertical axis of rotation relative to vehicle 600. In preferred embodiments, frame 200 is connected to host vehicle 600 such that frame 200 is allowed to pivot side-to-side relative to host vehicle 600. In some embodiments, frame 200 is connected to host vehicle 600 such that frame 200 is allowed to pivot up and down relative to host vehicle 600. In some embodiments, frame 200 is configured to be pushed by host vehicle 600. In some embodiments, frame 200 is configured to be pulled by host vehicle 600. In preferred embodiments, frame 200 is mounted ahead of host vehicle 600 in the direction of travel. In some embodiments, frame 200 may be towed by host vehicle 600, for example, using cables, chains, or ropes. In some embodiments, frame 200 is configured to provide a suitable distance between host vehicle 600 and the rollers 402 such that mines detonated by rollers 402 will not significantly damage host vehicle 600.

In one embodiment, frame 200 is configured to be secured to a host vehicle 600 and includes a first end 202 to be positioned proximate the host vehicle 600, a second end 204 positioned distally away from the first end 202, and side members 208*a* and 208*b* extending between the first end 202 and the second end 204. In one embodiment, side members 208*a* and 208*b* include bends 210*a* and 210*b* which divide side members 208*a* and 208*b* into distal portions 212*a* and 212*b* which extend from bends 210*a* and 210*b* towards the second end 204 of frame 200, and proximal portions 214*a* and 214*b* which extend from bends 210*a* and 210*b* towards the first end 202 of frame 200. In the embodiments shown in FIGS. 1A-1B, 2A-2C, and 3A-3C, distal portions 212*a* and 212*b* are substantially parallel relative to each other and proximal portions 214*a* and 214*b* converge towards one or more vehicle connectors 216 that are configured to connect with host vehicle 600. In the particular configuration shown, vehicle connector 216 includes a pintle ring 228 for attachment to host vehicle 600 as mentioned previously.

In one embodiment, frame 200 further includes a first transverse member 218 and a second transverse member 220 that are joined to and extend between distal portions 212*a* and 212*b* of side members 208*a* and 208*b*. In one embodiment, first transverse member 218 and second transverse member 220 extend substantially parallel to each other. In one embodiment first transverse member 218 and second transverse member 220 extend substantially perpendicular to distal portions 212*a* and 212*b* of side members 208*a* and 208*b*. In one embodiment, side members 208*a* and 208*b*, first transverse member 218 and second transverse member 220 lie substantially in a common plane. In one embodiment, one or more arms 300 are connected to the frame 200 proximate the second end 204 of frame 200. In one embodiment arms 300 are connected to second transverse member 220 of frame 200. In one embodiment, arms 300 are pivotably connected to second transverse member 220 of frame 200. In one embodiment, arms 300 extend from second transverse member 220 towards first end 202 of frame 200. In one embodiment, arms 300 extend below first transverse member 218 of frame 200. In one embodiment, roller system 100 includes a plurality of arms 300 extending substantially parallel to each other and arranged in a row along second transverse member 220.

In one embodiment, frame 200 further includes a third transverse member 222 mounted on at least one support 224 extending vertically from distal portions 212*a* and 212*b*. In one embodiment, third transverse member 222 extends substantially parallel to each of the first transverse member 218 and the second transverse member 220. In the particular embodiments shown in FIGS. 1A-1B, 2A-2C, and 3A-3C, third transverse member 222 is mounted upon two supports 224 extending from distal portion 212*a* and two supports 224 extending from distal portion 212*b*. In other embodiments, any suitable number of supports 224 may be used in roller system 100. In some embodiments, frame 200 includes a fourth transverse member 226. As shown in FIGS. 2A-2C, and 3A-3C, fourth transverse member 226 may extend between proximal portions 214*a* and 214*b* in a configuration substantially parallel to first and second transverse members 218 and 220.

Frame 200 may be constructed of any suitable material known in the art. For example, frame 200 may be constructed from metal (e.g., steel, titanium, aluminum, alloys), carbon fiber, fiber glass, rigid plastics, composites, etc. Frame 200 may be constructed from solid components or hollow components (e.g., tubing). Furthermore, frame 200 may be constructed from molded, cast, or machined components. In some embodiments, the components of frame 200 are fixed permanently together (e.g., by welding, brazing, soldering, adhering, fusing, gluing). In some embodiments, frame 200 is constructed to allow disassembly of frame 200. For example, the components of frame 200 may be clamped, bolted, or screwed together in some embodiments. In some embodiments, allowing disassembly of frame 200 facilitates the transport of roller system 100 and the replacement of parts. In some embodiments, frame 200 is an expandable frame such that the width of roller system 100 can increased or decreased as needed. For example, if the width of roller system 100 is less than the width of ground surface to be covered, additional passes of roller system 100 over the ground surface will be required to ensure complete coverage of the area. This results in longer clearance times, higher costs, and increased wear to the roller system 100, problems which can be avoided by increasing the width of roller system 100. In some embodiments, the transverse members of frame 200 (e.g., transverse members 218, 220, 222, 226) are removably connected to side members 208*a* and 208*b* such that they can be easily detached from side members 208*a* and 208*b* (e.g., without the need for cutting). For example, in some embodiments, the transverse members are mechanically fastened to side members 208*a* and 208*b* (e.g., using bolts, screws, clamps, etc.) so as to permit simple disassembly. In some embodiments, the transverse members may be screwed into side members 208*a* and 208*b*. In some embodiments, the transverse members may be connected to side members 208*a* and 208*b* by a bayonet-type connection. In some embodiments, frame 200 is configured such that transverse members of frame 200 (e.g., transverse members 218, 220, 222, and 226) may be substituted with shorter or longer members to adjust the total width of frame 200 and roller system 100, with arms 300, roller assemblies 400, and struts 500 being added or removed as needed to account for the change in width. For example, in one embodiment, the frame 200 shown in FIGS. 3A-3C can be adjusted by substituting transverse members 218, 220, 222, and 226 with transverse members of longer or shorter length while maintaining the same side members 208*a* and 208*b*. In some embodiments, the substituted members fit into the same connection points (e.g., along side members 208*a* and 208*b*) as the original members. In some embodiments, roller system 100 includes a kit having a plurality of interchangeable transverse members of different lengths that may be selected to increase or decrease the width of frame 200 depending on the particular needs of the operator. In some embodiments, the kit further includes additional arms 300, roller assemblies 400, and struts 500 to be added to roller system 100 if the width of frame 200 is expanded. In one embodiment, the additional arms 300 and struts 500 may attached to frame 200 using clamps (e.g., collar clamps) or other suitable mechanical fastener. In some embodiments, transverse members of frame 200 have a telescoping configuration to allow for lengthening or shortening of the transverse members as needed, thereby adjusting the width of frame 200. In one such configuration, the width of frame 200 can be adjusted without having to remove transverse members from frame 200. For example, the transverse members of frame 200 in one embodiment may have a configuration similar to a curtain rod. In another embodiment, transverse member of frame 200 may have a configuration similar to a turnbuckle.

In some embodiments, frame 200 is configured to accept additional weights to increase the total weight of roller system 100. The additional weights may be of any suitable form. For example, in some embodiments, metal plates, sandbags, stones, and/or containers filled with dirt or liquid, may be mounted onto frame 200 to increase the weight of roller system 100. In one embodiment, one or more additional weights are added on the side members 208*a* and 208*b* of frame 200. In one embodiment, one or more additional weights are added to one or more transverse members 218, 220, and 220. In some embodiments, increasing the total weight of roller system 100 permits a greater force to be applied to the ground surface, which may be needed to facilitate land mine clearance. In some embodiments, frame 200 may be configured to protect components of roller system 100 and/or host vehicle 600 from mine explosions and foreign material (e.g., shrapnel, debris, stones, etc.). For example, in one embodiment, frame 200 may include plates, shields, or deflectors arranged in any suitable configuration to protect against mine explosions and foreign material.

Pressure Distribution System:

In one embodiment of the invention, roller system 100 further includes a pressure distribution system for adjusting the force applied by roller system 100 to a surface (e.g., a ground surface). In one embodiment, the pressure distribution system is configured to equalize the force applied by each of the roller assemblies 400 to a surface. In one embodiment, the pressure distribution system is configured to increase the force applied by at least one roller assembly 400 to a surface. In some embodiments, the pressure distribution system is configured to reduce variations in the amount of force applied to the surface by roller system 100. This is particularly advantageous, in one embodiment, because fluctuations (e.g., spikes and dips) in the force applied to the ground surface can lead to uneven forces being exerted on the mines and allowing mines to remain unexploded. In some embodiments, the operator (e.g., demining personnel) determines the force required to detonate the mine type to be cleared and adjusts the roller system 100 accordingly to apply the necessary force. In some embodiments, the pressure distribution system is configured such that the necessary force is applied to the surface by each of the roller assemblies 400 in roller system 100.

In one embodiment of the invention, the pressure distribution system includes at least one strut 500 having a first end 502 connected to frame 200 and a second end 504 connected to an arm 300. In one embodiment, first end 502 is pivotably connected to frame 200 and second end 504 is pivotably connected to arm 300. Strut 500 may be removably or adjustably mounted onto frame 200 in a manner similar to arm 300 (e.g., using a collar clamp), such that struts 500 may be added or removed as needed. In one embodiment, the pressure distribution system includes a number of struts 500 equal to the number of arms present in roller system 100. In one embodiment, the pressure distribution system includes a plurality of struts 500, each strut 500 being connected to a different arm 300. In one embodiment, strut 500 is connected to arm 300 at a point intermediate proximal end 304 and distal end 306 of arm 300. In one embodiment, strut 500 is connected to arm 300 at proximal end 304 of arm 300. In one embodiment, each strut 500 is positioned at least partially above the arm 300 to which the strut 500 is connected. In one embodiment, first end 502 of strut 500 is connected to the third transverse member 222 of frame 200. In one embodiment, strut 500 is configured to pivot arm 300 relative to frame 200. In one embodiment, strut 500 is configured to pivot arm 300 towards a ground surface. In one embodiment, strut 500 is configured to apply a downward force on arm 300. In one embodiment, the downward force of strut 500 on arm 300 is transferred to the roller assembly 400 connected to the arm 300, thereby causing rollers 402 attached to the arm 300 to exert a greater force on the ground surface. In one embodiment, roller system 100 further includes a pressure source 516 to increase the fluidic pressure of one or more struts 500. In one embodiment, pressure source 516 includes one or more pumps or compressors in fluid communication with struts 500.

Figure 7A:
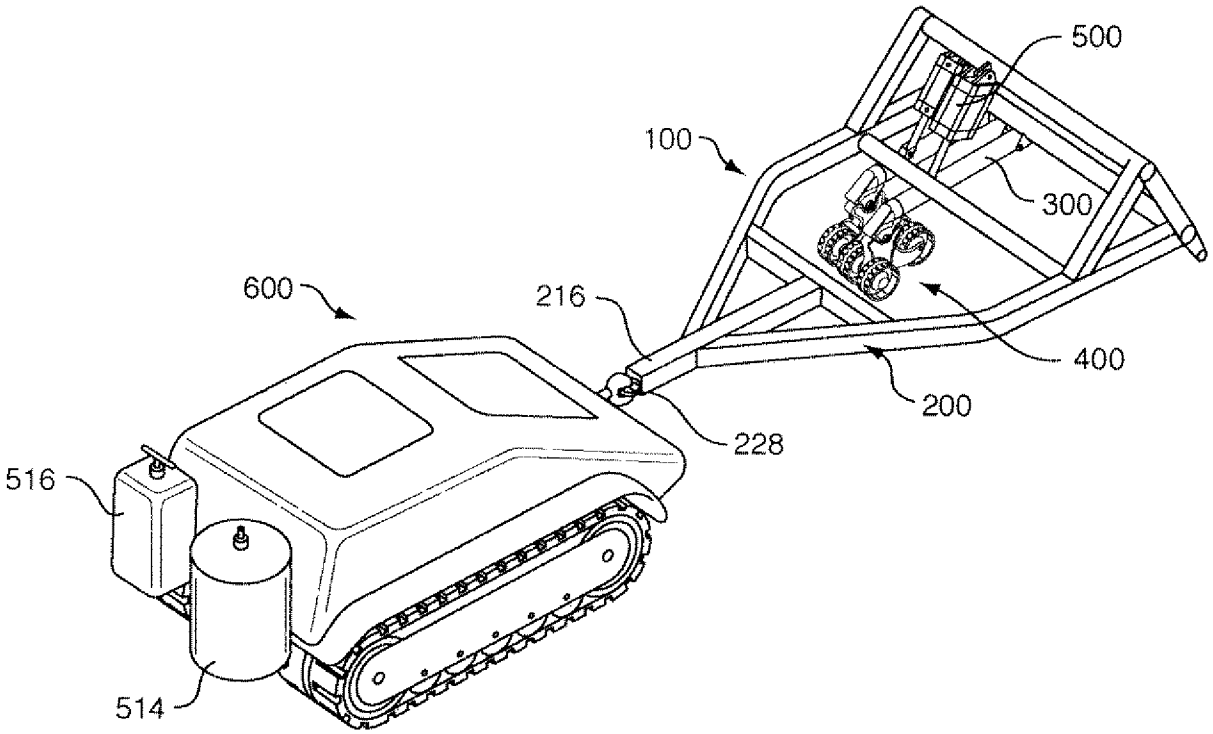
FIGS. 7A and 7B show pressure source and accumulator mounting arrangements in accordance with embodiments of the present invention.
Figure 7B:
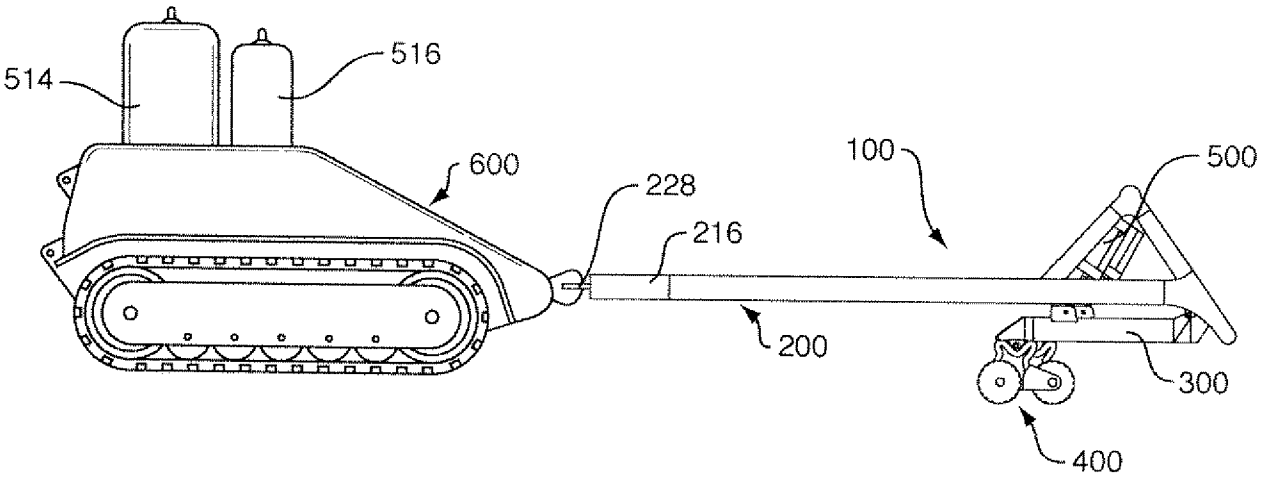
Figure 8:
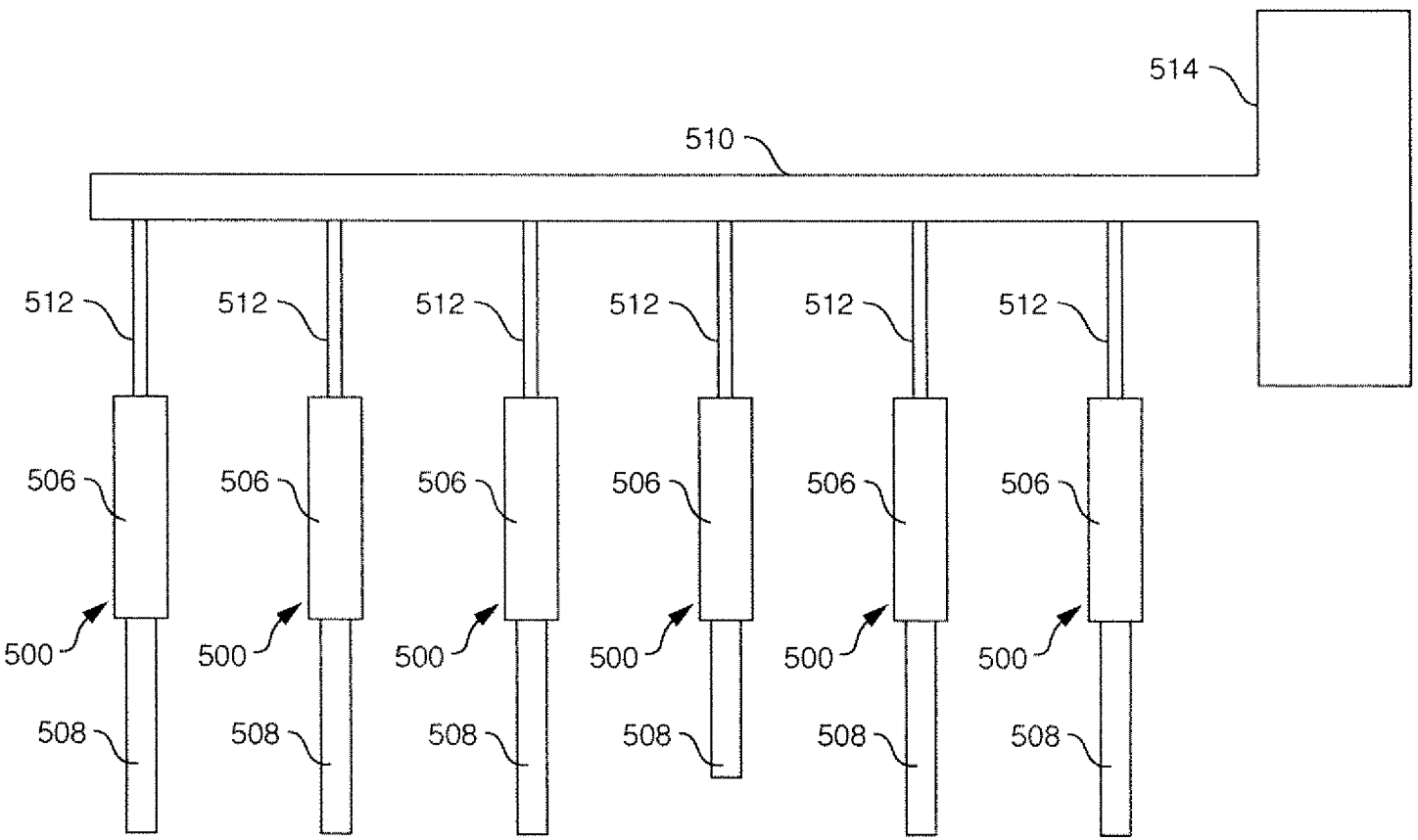
FIG. 8 shows a pressure distribution system arrangement in accordance with one embodiment of the present invention.
Figure 10:
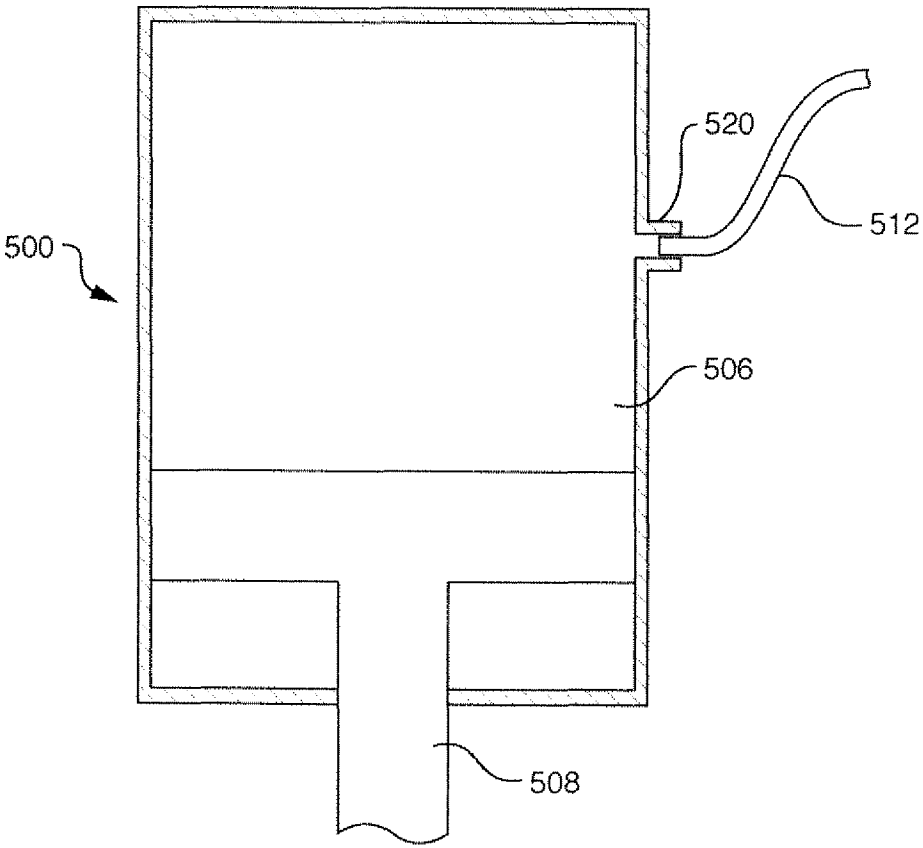
FIG. 10 shows a strut in accordance with one embodiment of the present invention.

In one embodiment, strut 500 includes a piston having a cylinder 506 and a piston rod 508 slidably engaged with the cylinder 506. FIG. 10 shows one embodiment of strut 500 for use with the present invention. In some embodiments, strut 500 includes a single-acting piston, for example, a piston configured to admit working fluid (e.g., pressurized gas) on one side of the piston only. In one embodiment, strut 500 includes a hydraulic piston. In a preferred embodiment, strut 500 includes a pneumatic piston configured such that piston rod 508 is extendible in response to gas pressure in cylinder 506. In one embodiment, the pressure distribution system further includes a manifold 510 to which one or more struts 500 are fluidly connected through tubing 512. In one embodiment, manifold 510 is fluidly connected to cylinders 506 through tubing 512, as shown, for example, in FIG. 8. In one embodiment, tubing 512 connects to an inlet 520 on cylinder 506. Tubing 512 may be either flexible or rigid. In one embodiment, tubing 512 is protected from foreign material (e.g, shrapnel, debris, etc.). In one embodiment, tubing 512 may be at least partially housed within frame 200. For example, in one embodiment, at least a portion of tubing 512 may extend through one or more of the transverse members 218, 220, or 222, or side members 208*a* and 208*b*. In one embodiment, the pressure distribution system may optionally include at least one accumulator 514 that is in fluid communication with manifold 510 and struts 500. In one embodiment, accumulator 514 serves to increase the overall volume of the pneumatic system and serves as a reservoir to balance pressure between the cylinders 506. In one embodiment, accumulator 514 may be mounted onto host vehicle 600. For example, accumulator 514 may be mounted on the rear of host vehicle 600, as shown in FIG. 7A, or accumulator 514 may be mounted on the top of host vehicle 600, as shown in FIG. 7B.

In one embodiment, the pressure distribution system is a closed pneumatic system. In one embodiment, the closed pneumatic system is initially pressurized by a suitable pressure source 516 (e.g., pump, compressor, gas cylinder, etc.) connected thereto. Once sufficiently pressurized, the pressure source 516 may then be disconnected from the closed pneumatic system. In one example, struts 500, tubing 512, and manifold 510 are in fluid communication with each other and form a closed pneumatic system such that the amount of gas (e.g., compressed air) within struts 500, tubing 512, and manifold 510 remains substantially constant and the steady-state pneumatic pressure in each of the struts 500 is equal. Because struts 500 are further connected to pivoting arms 300, the closed pneumatic system according to this embodiment ensures that the force applied to the ground surface by each roller assembly 400 is substantially equalized. When one of the roller assemblies 400 of the roller system 100 passes over an obstacle (e.g., a rock or bump in the terrain), the arm 300 connected to the roller assembly 400 will move upwards causing the piston rod 508 attached thereto to slide upwards into its respective cylinder 506 and causing a momentary increase in the pneumatic pressure within cylinder 506. Because cylinder 506 is in fluid communication with manifold 510, the increase in pneumatic pressure within cylinder 506 will cause gas to exit cylinder 506 via tubing 512 into the manifold 510, which in turn distributes the gas into the remaining cylinders 506. This distribution of the gas causes the gas volume in remaining cylinders 506 to expand, causing their respective piston rods 508 to slide downward and returning the closed pneumatic system towards its steady-state pressure. Furthermore, the extension of remaining piston rods 508 downward pushes the arms 300 and the roller assemblies 400 connected thereto towards the ground surface thereby maintaining ground coverage.

In one embodiment, roller system includes a plurality of manifolds 510, each manifold 510 being connected to a different plurality of struts 500, a switch 518, and one or more pressure sources 516. In some embodiments, pressure source 516 may be mounted onto host vehicle 600, as shown in FIGS. 7A and 7B. In one embodiment, switch 518 selectively connects one of the plurality of manifolds 510 with the one or more pressure sources 516 with, thereby increasing the pressure in the struts 500 connected to the particular manifold 510 and increasing the force applied to the ground surface by the respective roller assemblies 400 attached thereto. In some embodiments, most or all of the weight of the roller assembly 100 is transferred to the roller assemblies 400 connected to struts 500 that are pressurized, thereby increasing the force that the roller assemblies 400 apply to the ground surface. In one embodiment, the force applied to the ground surface increases from about 1% to about 25%. In one embodiment, the force applied to the ground surface increases from about 25% to about 50%. In one embodiment, the force applied to the ground surface increases from about 50% to about 75%. In one embodiment, the force applied to the ground surface increases from about 75% to about 100%. In one embodiment, the force applied to the ground surface increases from about 100% to about 125%. In one embodiment, the force applied to the ground surface increases from about 125% to about 150%. In one embodiment, the force applied to the ground surface increases from about 150% to about 175%. In one embodiment, the force applied to the ground surface increases from about 175% to about 200%. In one embodiment, the force applied to the ground surface increases from about 200% to about 225%. In one embodiment, the force applied to the ground surface increases from about 225% to about 250%. In one embodiment, the force applied to the ground surface increases from about 250% to about 275%. In one embodiment, the force applied to the ground surface increases from about 275% to about 300%. In one embodiment, the force applied to the ground surface increases more than about 300%. In one variation of this embodiment, the manifolds 510 not connected by switch 518 to the one or more pressure sources 516 will vent the gas contained in the struts 500 connected thereto, thereby decreasing the pressure of these struts 500.

Figure 9A:
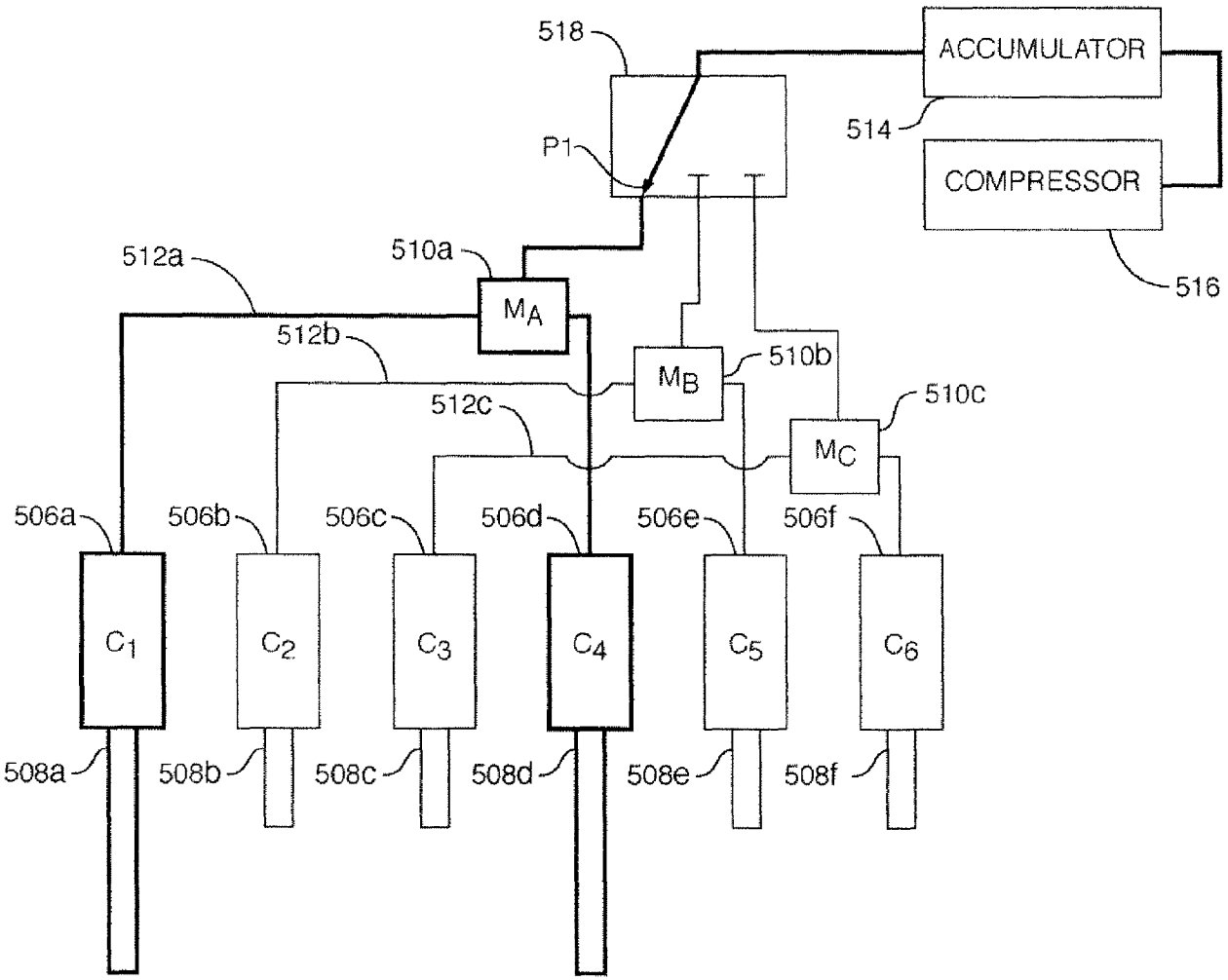
FIGS. 9A-9C show a pressure distribution system arrangement in accordance with another embodiment of the present invention.
Figure 9B:
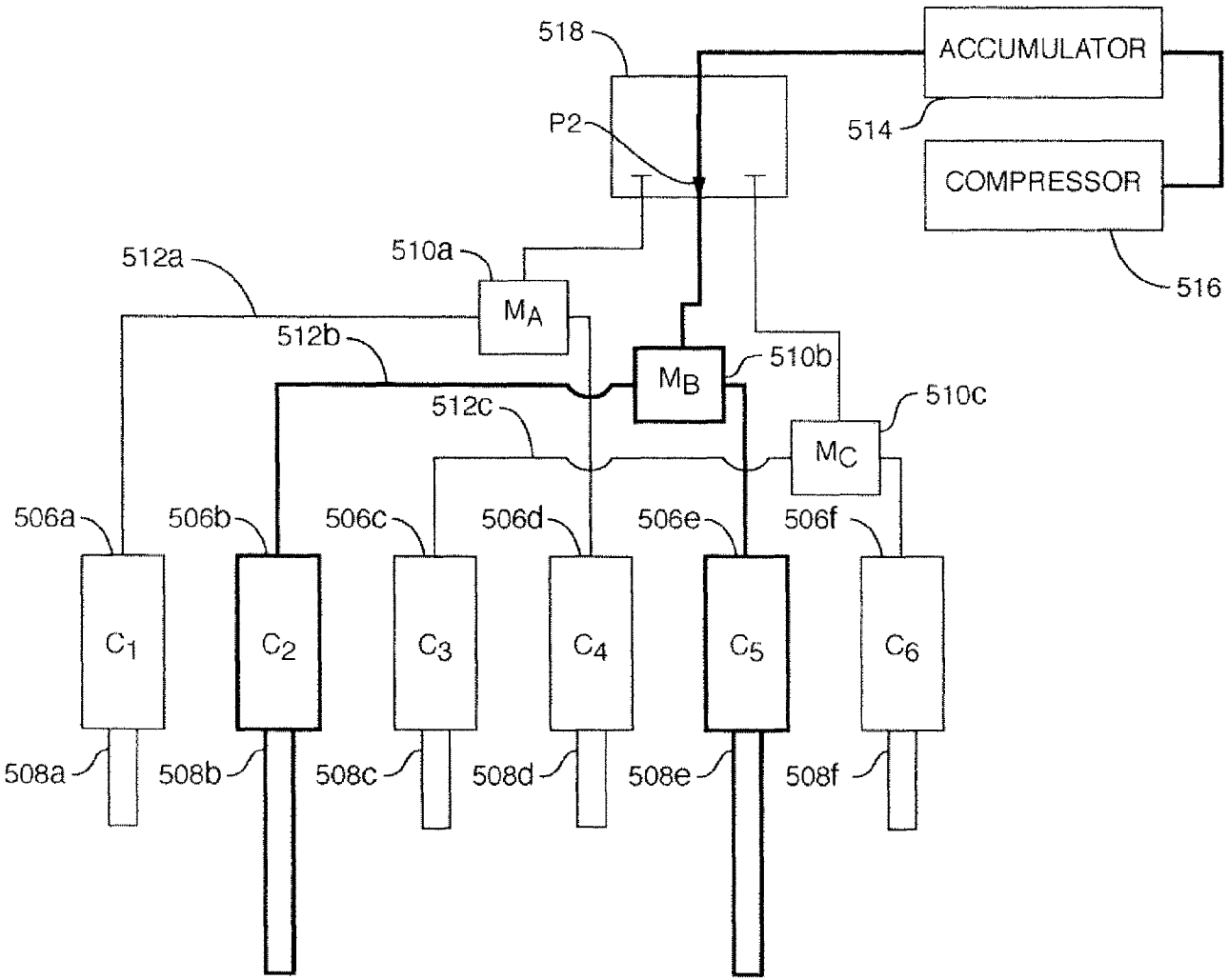
Figure 9C:
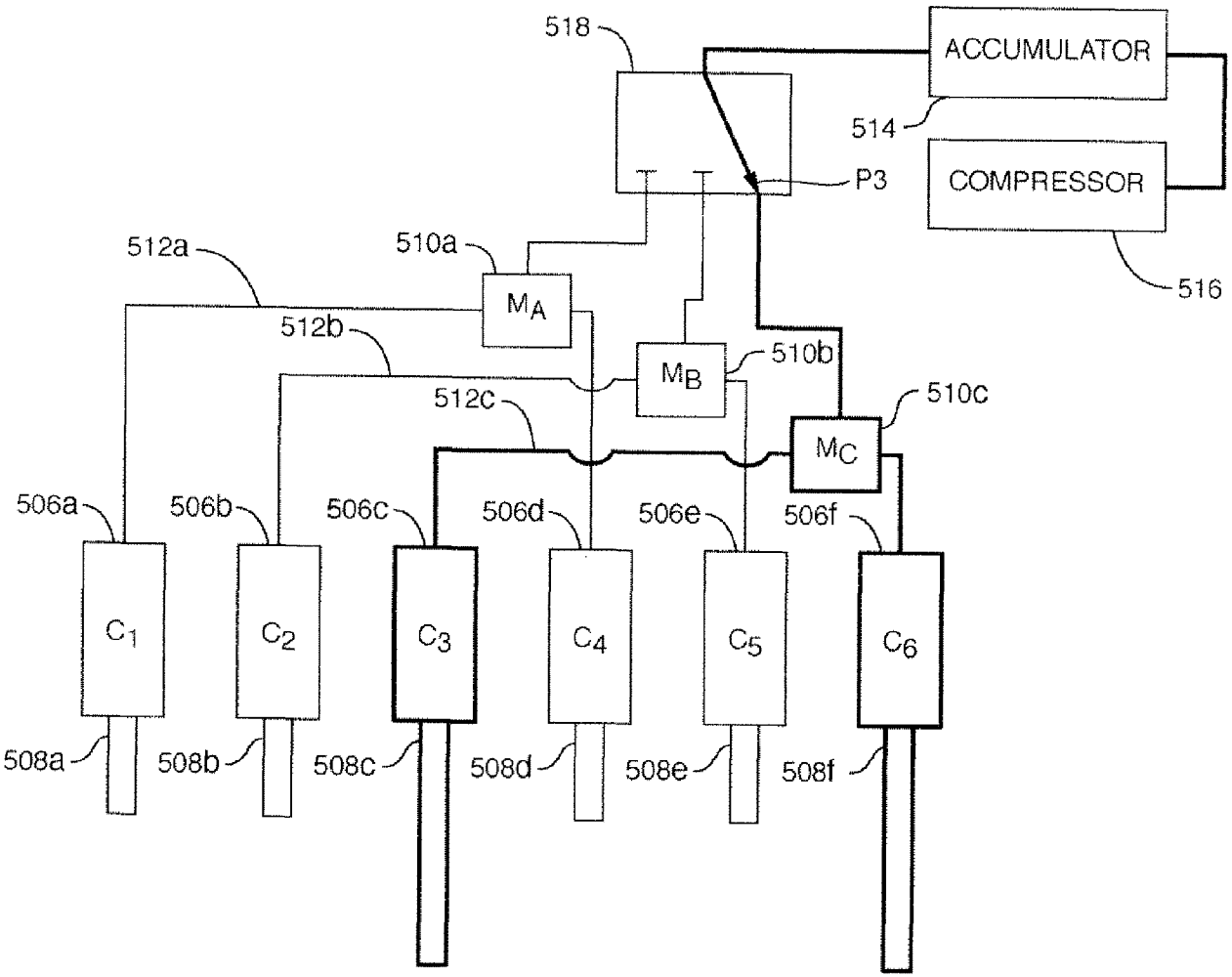

FIGS. 9A-9C shows one example of a pressure distribution system for use with the present invention. In this embodiment, the pressure distribution system includes a pressure source 516, an accumulator 514, switch 518, a plurality of manifolds 510*a*-510*c*, and a plurality of struts 500*a-f* including respective cylinders 506*a*-506*f* and piston rods 508*a*-508*f*. In this particular embodiment, cylinders 506*a* and 506*d* are in fluid connection with manifold 510*a* via tubing 512*a*, cylinders 506*b* and 506*e* are in fluid connection with manifold 510*b* via tubing 512*b*, and cylinders 506*c* and 506*f* are in fluid connection with manifold 510*c* via tubing 512*c*. As shown in FIG. 9A, switch 518 may be set to a first position P1 such that pressure source 516 and accumulator 514 are brought into fluid communication with manifold 510*a*, thereby causing the pressure in cylinders 506*a* and 506*d* to increase. As a result, piston rods 508*a* and 508*d* are pushed out of cylinders 506*a* and 506*d* respectively, thereby driving arms and roller assemblies connected thereto (not shown) downward and increasing the force they apply to the ground surface. When switch 518 is set to a second position P2, as shown in FIG. 9B, pressure source 516 and accumulator 514 are brought into fluid communication with manifold 510*b*, thereby increasing the pressure in cylinders 506*b* and 506*e* and allowing the arms and roller assemblies connected to piston rods 508*b* and 508*e* to apply a greater force on the surface. When switch 518 is set to a third position P3, as shown in FIG. 9C, pressure source 516 and accumulator 514 are brought into fluid communication with manifold 510*c*, thereby increasing the pressure in cylinders 506*c* and 506*f* and allowing the arms and roller assemblies connected to piston rods 508*c* and 508*f* to apply a greater force on the surface. In one embodiment, switch 518 is configured to cycle through each position several times per second. In one embodiment, the timing of switch 518 is adjustable by an operator. In one embodiment, the cycling of switch 518 is automated. In some embodiments, most or all of the weight of the roller assembly 100 is concentrated on the surface under the rollers 402 connected to cylinders 506 that are pressurized. In this manner, the force applied to the surface by the rollers may more than double or triple when their respective cylinder is pressurized. For example, a roller applying a force of about 60 pounds on a surface when not being pressurized by the pressure distribution system may apply a force of about 180 pounds on the surface when its respective cylinder is pressurized.

Preferably, roller system 100 may be configured to apply forces sufficient to detonate any type of land mine. For example, anti-personnel mines may require a force of about fifteen pounds to about 350 pounds to detonate whereas anti-tank mines may require a force of about 300 to about 600 pounds to detonate. In some embodiments, roller system 100 is configured to apply a force of about 50 pounds to about 650 pounds to the surface. In some embodiments, roller system 100 is configured to apply a force of about 100 pounds to about 550 pounds to the surface. In some embodiments, roller system 100 is configured to apply a force of about 150 to about 500 pounds to a surface. In some embodiments, roller system 100 is configured to apply a force of about 200 pounds to about 450 pounds to a surface. In some embodiments, roller system 100 is configured to apply a force of about 250 pounds to about 400 pounds to a surface. In some embodiments, roller system 100 is configured to apply a force of about 300 pounds to about 350 pounds to a surface.

While the invention has been described above with respect to particular embodiments, modifications and substitutions within the spirit and scope of the invention will be apparent to those of skill in the art. It should also be apparent that individual elements identified herein as belonging to a particular embodiment, may be included in other embodiments of the invention. The present invention may be embodied in other specific forms without departing from the central attributes thereof. Therefore, the illustrated embodiments and examples should be considered in all respects as illustrative and not restrictive, reference being made to the appended claims rather than the foregoing description to indicate the scope of the invention.

What is claimed is:

1. A roller system comprising:

a frame configured to be pushed by a host vehicle;

a plurality of arm assemblies configured to apply force to a surface, wherein the applied force is independent of a weight of the host vehicle, each arm assembly including:

an arm pivotably connected to the frame; and a roller assembly pivotably connected to the arm and having a plurality of rollers configured to engage with the surface; and a pressure distribution system configured to adjust the force applied to the surface by each of the plurality of arm assemblies independently of the weight of the host vehicle, wherein the pressure distribution system comprises:

a pressure source;

a plurality of pneumatic circuits, each pneumatic circuit including a manifold and one or more pneumatic pistons connected to the manifold; and a switch having a plurality of positions for selectively connecting each pneumatic circuit with the pressure source, wherein each switch position corresponds to a different pneumatic circuit, and wherein the switch is configured to automatically cycle through each position at least once a second;

wherein each pneumatic piston of the pressure distribution system is connected to an arm assembly and configured to apply a force on the arm assembly when its respective pneumatic circuit is connected to the pressure source by the switch.

2. The roller system of claim 1, wherein the rollers are configured to roll over the surface and detonate a land mine positioned along or under the surface.

3. The roller system of claim 1, wherein the rollers of a roller assembly are arranged in one or more rows.

4. The roller system of claim 3, wherein the rollers are arranged in two or more rows, each row having one or more rollers.

5. The roller system of claim 4, wherein the rows are substantially parallel.

6. The roller system of claim 4, wherein at least two of the rows have the same number of rollers.

7. The roller system of claim 4, wherein each sequential row has a greater number of rollers.

8. The roller system of claim 4, wherein the rollers in a first row are staggered in relation to the rollers in a second row.

9. The roller system of claim 8, wherein a distance between adjacent rollers in the first row is equal to or less than the width of a roller in the second row.

10. The roller system of claim 1, wherein two or more rollers of a roller assembly have different axes of rotation.

11. The roller system of claim 1, wherein the rollers of a roller assembly are arranged in a substantially triangular configuration.

12. The roller system of claim 1, wherein each roller assembly includes three rollers.

13. The roller system of claim 1, wherein the roller assembly is configured to pivot relative to the arm in at least one vertical plane.

14. The roller system of claim 1, wherein the roller assembly is configured to rotate about an axis of rotation that is substantially perpendicular to a longitudinal axis of the arm.

15. The roller system of claim 1, wherein side-to-side motion of the roller assembly relative to the arm is limited.

16. The roller system of claim 1, wherein the arm is configured to pivot relative to the frame in at least one vertical plane.

17. The roller system of claim 1, wherein the arm assemblies are arranged substantially in a row along a portion of the frame.

18. The roller system of claim 1, wherein the arm assemblies are arranged substantially parallel to each other.

19. The roller system of claim 1, wherein the pressure distribution system is configured to increase the force applied by at least one of the arm assemblies to the surface.

20. The roller system of claim 1, wherein the pressure distribution system is configured to apply a force sequentially to each of the arm assemblies.

21. The roller system of claim 1, wherein the pressure distribution system includes a strut connected to at least one of the plurality of arm assemblies.

22. The roller system of claim 21, wherein the strut is extendible.

23. The roller system of claim 21, wherein the pressure distribution system includes a pressure source configured to pressurize the strut.

24. The roller system of claim 23, wherein the pressure source comprises at least one of a compressor, pump, and gas cylinder.

25. The roller system of claim 23, wherein the pressure distribution system further includes an accumulator in communication with the pressure source.

26. The roller system of claim 21, wherein the pressure distribution system includes a plurality of struts, each of the plurality of struts connected to a different arm assembly.

27. The roller system of claim 26, wherein at least two of the plurality of struts are in fluid communication with each other.

28. The roller system of claim 27, wherein each of the plurality of struts is in fluid communication with each other.

29. The roller system of claim 26, wherein the pressure distribution system includes a manifold and wherein at least two of the plurality of struts are connected to the manifold.

30. The roller system of claim 21, wherein the strut comprises a piston.

31. The roller system of claim 30, wherein the piston is configured to pivot an arm assembly relative to the frame in response to a change in fluid pressure within the piston.

32. The roller system of claim 1, wherein the pressure distribution system is a closed pneumatic system.

33. The roller system of claim 1, wherein the switch is configured to connect each pneumatic circuit with the pressure source one at a time.

34. The roller system of claim 1, wherein the frame is configured to be connected to a vehicle.

35. The roller system of claim 34, wherein the frame is pivotably connected to the vehicle.

36. The roller system of claim 1, wherein the frame includes a side member and a first transverse member removably connected to the side member, the first transverse member having a length and being positioned substantially perpendicular to the side member.

37. The roller system of claim 1, wherein the roller system is configured to allow the number of arm assemblies to be adjusted.

38. The roller system of claim 1, wherein each roller includes a closeable inlet.

* * * * *